US009316987B2

(12) United States Patent
Hitosugi et al.

(10) Patent No.: US 9,316,987 B2
(45) Date of Patent: Apr. 19, 2016

(54) IMAGE FORMING APPARATUS AND IMAGE FORMING METHOD

(71) Applicants: Jun Hitosugi, Tokyo (JP); Takamasa Ozeki, Kanagawa (JP); Mutsuki Morinaga, Kanagawa (JP); Emiko Shiraishi, Tokyo (JP); Wakana Itoh, Kanagawa (JP); Hitoshi Yamamoto, Kanagawa (JP); Takatsugu Komori, Chiba (JP); Tadashi Kasai, Kanagawa (JP); Makoto Yasuda, Kanagawa (JP); Kunio Hasegawa, Kanagawa (JP)

(72) Inventors: Jun Hitosugi, Tokyo (JP); Takamasa Ozeki, Kanagawa (JP); Mutsuki Morinaga, Kanagawa (JP); Emiko Shiraishi, Tokyo (JP); Wakana Itoh, Kanagawa (JP); Hitoshi Yamamoto, Kanagawa (JP); Takatsugu Komori, Chiba (JP); Tadashi Kasai, Kanagawa (JP); Makoto Yasuda, Kanagawa (JP); Kunio Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/742,585

(22) Filed: Jun. 17, 2015

(65) Prior Publication Data

US 2015/0370206 A1 Dec. 24, 2015

(30) Foreign Application Priority Data

Jun. 18, 2014 (JP) ..... 2014-125245
Sep. 3, 2014 (JP) ..... 2014-179368

(51) Int. Cl.
*G03G 15/00* (2006.01)
*G03G 15/01* (2006.01)

(52) U.S. Cl.
CPC ..... *G03G 15/6585* (2013.01); *G03G 15/0121* (2013.01); *G03G 15/55* (2013.01)

(58) Field of Classification Search
CPC ..... G03G 15/6585; G03G 2215/00805; G03G 2215/0081
See application file for complete search history.

(56) References Cited

U.S. PATENT DOCUMENTS 4,391,502 A * 7/1983 Nishikawa ..... G03G 15/065 355/67
2005/0191073 A1* 9/2005 Kawamura ..... G03G 15/0806 399/55

(Continued)

FOREIGN PATENT DOCUMENTS

JP 2007-298902 11/2007

*Primary Examiner* — David Gray
*Assistant Examiner* — Carla Therrien
(74) *Attorney, Agent, or Firm* — Duft Bornsen & Fettig LLP

(57) ABSTRACT

An image forming apparatus includes a photoconductor to form an electrostatic latent image, a special color developing device to develop the latent image with a special color toner other than standard color toners to form a special color toner image, an adhesion amount adjuster to adjust a special color toner adhesion amount by changing an application bias between the photoconductor and a developing sleeve of the special color developing device, a setting unit to set brightness of the special color toner, and a developing-performance adjuster to adjust a developing performance of the special color developing device according to a setting value of the brightness set by the setting unit. The developing-performance adjuster adjusts the developing performance of the special color developing device to a developing performance different from a developing performance set to each of standard color developing devices in adjustment of densities of the standard color toners.

12 Claims, 13 Drawing Sheets

(56) References Cited

U.S. PATENT DOCUMENTS

2006/0198649 A1* 9/2006 Imamiya ..... G03G 9/09 399/53
2011/0123209 A1* 5/2011 Akita ..... G03G 15/0131 399/49
2011/0206401 A1* 8/2011 Sone ..... G03G 15/0194 399/67
2011/0236045 A1* 9/2011 Tanaka ..... G03G 15/50 399/45
2012/0105915 A1 5/2012 Kobayashi et al.
2012/0229819 A1* 9/2012 Koyatsu ..... G03G 15/0126 358/1.1
2012/0237234 A1* 9/2012 Sugimoto ..... G03G 15/1675 399/50
2012/0237244 A1* 9/2012 Yoshikawa ..... G03G 15/6585 399/67
2013/0101303 A1* 4/2013 Kasai ..... G03G 15/205 399/45
2013/0278943 A1* 10/2013 Kurosawa ..... G03G 15/0121 358/1.1
2014/0348521 A1 11/2014 Mase et al.
2015/0029518 A1* 1/2015 Tashiro ..... G03G 15/5025 358/1.1

* cited by examiner

1031

| ADHESION AMOUNT CLASS (MODE) | ADHESION-AMOUNT THRESHOLD | DEVELOPING $\gamma$ SETTING VALUE | VELOCITY RATIO OF DEVELOPING SLEEVE |
|---|---|---|---|
| | [mg/cm$^2$] | [mg/cm$^2$/-kV] | [-] |
| 1 | $M < 0.5$ | 1.00 | 1.50 |
| 2 | $0.5 \leq M < 0.8$ | 1.50 | 1.55 |
| 3 | $0.8 \leq M < 1.3$ | 2.10 | 1.78 |
| 4 | $1.3 \leq M$ | 3.15 | 1.92 |

FIG. 9

1032

| WHITE TONER BRIGHTNESS | TONER ADHESION AMOUNT ON SHEET | SELECTION RESULT OF ADHESION AMOUNT CLASS | DEVELOPING $\gamma$ SETTING VALUE | VELOCITY RATIO OF DEVELOPING SLEEVE |
|---|---|---|---|---|
| 【L*】 | [mg/cm$^2$] | | [mg/cm$^2$/-kV] | [-] |
| 50 | 0.3 | 1 | 1.00 | 1.50 |
| 60 | 0.4 | 1 | 1.00 | 1.50 |
| 70 | 0.7 | 2 | 1.50 | 1.55 |
| 80 | 1.0 | 3 | 2.10 | 1.78 |
| 85 | 1.5 | 4 | 3.15 | 1.92 |

FIG. 13

| | | |
|---|---|---|
| SHEET FEEDING | SHEET FEEDING ADJUSTMENT 1 | * * * |
| | | * * * |
| | SHEET FEEDING ADJUSTMENT 2 | * * * |
| | | * * * |
| CONVEYANCE | CONVEYOR DETECTION ADJUSTMENT | * * * |
| | | * * * |
| IMAGE POSITION AND SCALING | PRINT POSITION ADJUSTMENT | * * * |
| | | * * * |
| | ADJUSTMENT OF MASKING RANGE OF LEADING AND TRAILING EDGES | * * * |
| | | * * * |
| DRIVING SYSTEM | PROCESS VELOCITY SETTING | * * * |
| | | * * * |
| | FINE TUNING OF LINEAR VELOCITY OF COMPONENTS | * * * |
| | | * * * |
| IMAGE FORMING SYSTEM | IMAGE DENSITY ADJUSTMENT | STANDARD COLOR IMAGE DENSITIES: KCMY |
| | | WHITE TONER BRIGHTNESS: WHITE |
| | | * * * |
| | TRANSFER CURRENT ADJUSTMENT | * * * |
| | | * * * |
| | FIXING TEMPERATURE ADJUSTMENT | * * * |
| | | * * * |

| ITEM | PRINT MODE | |
|---|---|---|
| | IMAGE QUALITY FIRST | PRODUCTIVITY FIRST |
| IMAGE QUALITY | EXCELLENT | GOOD |
| PRODUCTIVITY | FAIR | EXCELLENT |
| DEVELOPING PERFORMANCE | ADJUSTABLE | FIXED |
| DEVELOPING PERFORMANCE ADJUSTMENT OPERATION | PERFORM ADJUSTMENT OPERATION FOR EACH JOB OF DIFFERENT ADHESION AMOUNT | PEFORM OPERATION BEFORE MIXED JOB AND NOT PERFORM OPERATION WITHIN JOB |

IMAGE FORMING APPARATUS AND IMAGE FORMING METHOD

CROSS-REFERENCE TO RELATED APPLICATIONS

This patent application is based on and claims priority pursuant to 35 U.S.C. §119(a) to Japanese Patent Application No. 2014-125245, filed on Jun. 18, 2014, and Japanese Patent Application No. 2014-179368, filed on Sep. 3, 2014 in the Japan Patent Office, the entire disclosures of which are hereby incorporated by reference herein.

BACKGROUND

1. Technical Field

Aspects of the present disclosure relate to an image forming apparatus and an image forming method using standard color toners and a special color toner such as a white color.

2. Description of the Related Art

In a recent electrophotographic device, special color toners can be used in addition to yellow (Y), magenta (M), cyan (C), and black (K) (CMYK) standard color toners.

This type of electrophotographic device can include one or more imaging stations for the special color toners in addition to four imaging stations corresponding to the CMYK standard color toners or replace the imaging stations of the standard color toners with the imaging stations for the special color toners.

As one of the special color toners, there is a white color toner. As an example of image forming using the white color toner, there is a print method of superimposing a white color toner image on a standard color toner image for translucent media (print media such as an overhead projector (OHP) sheet, OZK, and ALINDA). In a print material obtained by a print result, when an image is viewed from the translucent media side, a background image is not viewed translucently by the added white color toner image and a print material of a high added value that is uniformly glossy by a glossy feeling of the translucent media can be generated. In addition, a print material obtained by loading the white color toner on a normal print image (color image) by characteristic patterns, letters, logos, and symbols, performing print, and giving brightness of the white color toner as a decorative effect is expected as a print material of a high added value.

SUMMARY

In an aspect of the present disclosure, there is provided an image forming apparatus including a photoconductor, a special color developing device, an adhesion amount adjuster, a setting unit, and a developing-performance adjuster. The photoconductor forms an electrostatic latent image. The special color developing device develops the electrostatic latent image with a special color toner other than standard color toners on the photoconductor to form a special color toner image. The adhesion amount adjuster adjusts a special color toner adhesion amount by changing an application bias between the photoconductor and a developing sleeve of the special color developing device. The setting unit sets brightness of the special color toner. The developing-performance adjuster adjusts a developing performance of the special color developing device according to a setting value of the brightness of the special color toner set by the setting unit. The developing-performance adjuster adjusts the developing performance of the special color developing device to a developing performance different from a developing performance set to each of standard color developing devices in adjustment of densities of the standard color toners.

In an aspect of the present disclosure, there is provided an image forming method including forming an electrostatic latent image on a photoconductor, developing the electrostatic latent image on the photoconductor with a special color toner other than standard color toners to form a special color toner image, adjusting a special color toner adhesion amount by changing an application bias between the photoconductor and a developing sleeve of the special color developing device, setting brightness of the special color toner, adjusting a developing performance of the special color developing device according to a setting value of the brightness of the special color toner, and adjusting the developing performance of the special color developing device to a developing performance different from a developing performance set to each of standard color developing devices in adjustment of densities of the standard color toners.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 9 is a table illustrating a registration example of brightness adjustment control parameters of a white color toner;

FIG. 13 is a table illustrating a setting example of a target brightness value for each sheet used for setting brightness of a white color toner;

Figure 1:
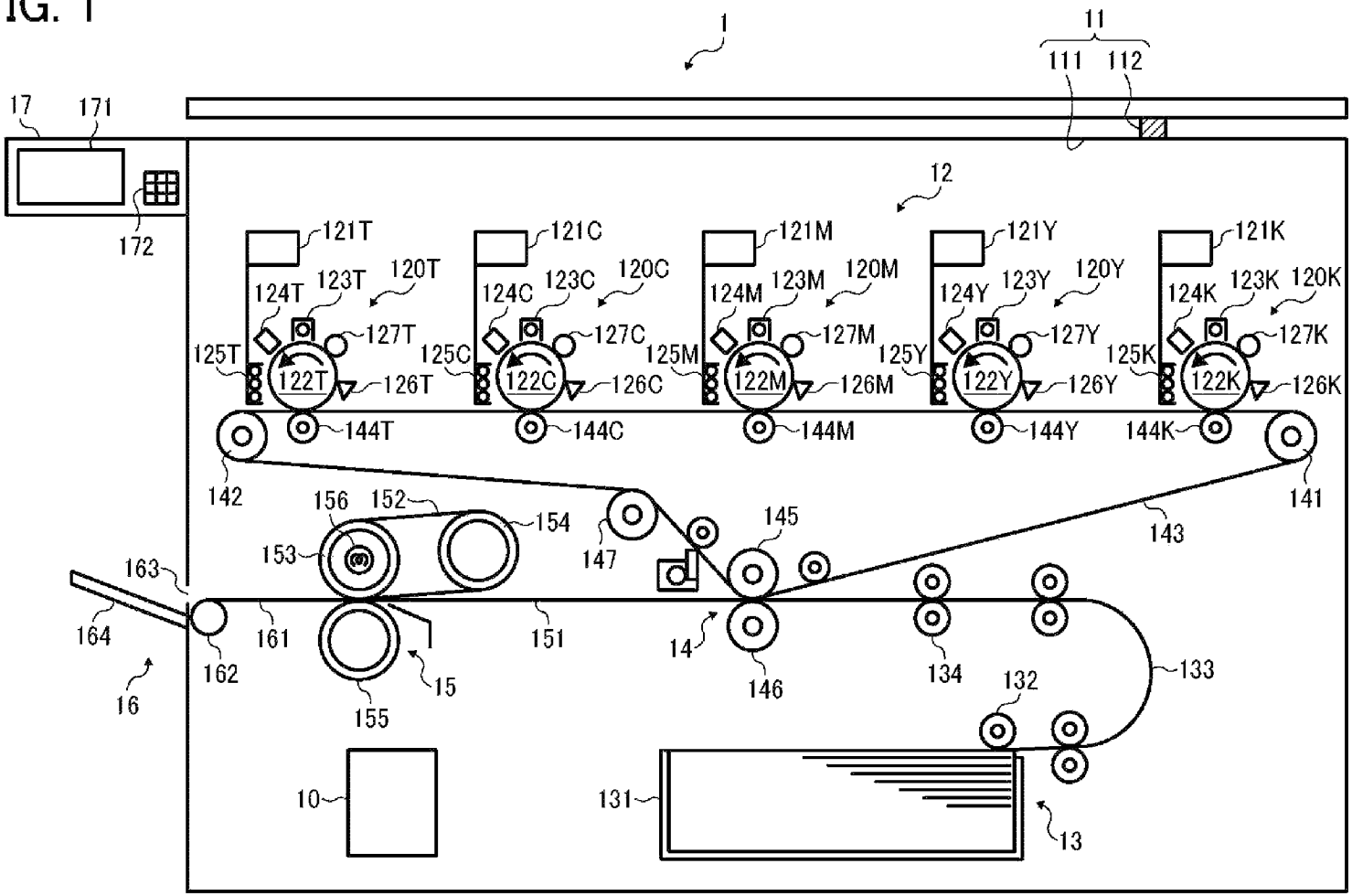
FIG. 1 is a schematic view of a configuration of hardware of an image forming apparatus according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

In an image forming apparatus using standard colors (also referred to as process colors) and a special color, brightness adjustment of a white color toner print material is executed often at the side of a user, from the viewpoint of image adjustment. Generally, density adjustment of the standard color and brightness adjustment of the white color toner are executed by changing a toner adhesion amount on a sheet. In this case, the toner adhesion amount on the sheet can be adjusted by a user notch. However, in an image forming apparatus, an adjustment range of a toner adhesion amount for the standard color toner is limited to an adhesion amount range that can correspond to developing performance of a system at a fixed value (with some adjustment width).

Here, if market requests regarding image adjustment for a full-color toner and a white color toner in the image forming apparatus are compared, a change of an adhesion amount greatly deviating from an adjustable range is not requested for the full-color toner, because color reproducibility is first. Meanwhile, in the white color toner, because a use is requested as a decoration appeal rather than the color reproductivity, a required variable range of the adhesion amount is wider than a required variable range of the full-color toner.

As toner density adjustment technology for the standard color toner, for example, a configuration is proposed in which a toner density of a developing device of which developing performance is not in a predetermined range is adjusted according to an execution result of adjustment (process control) of imaging conditions such as a developing bias, a charged potential, and an exposure potential (exposure).

However, in such an image forming apparatus, when the special color toner is used in addition to the standard color toners, a range of developing performance at the time of adjusting the density for the standard color toner is applied for brightness adjustment of the special color toner. That is, in a fixed developing performance system adopted by the image forming apparatus, a density adjustment width is suppressed in a relatively narrow range from the viewpoint of color reproductivity, for the standard color toners, and the developing performance is fixed at the time of adjusting the brightness of the white color toner. For this reason, it is difficult to correspond to large adhesion amount change and adjustment required for the white color toner.

Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment

First, a basic configuration of an image forming apparatus will be described. An image forming apparatus 1 according to this embodiment is applied to an image forming apparatus equipped with a white color image forming unit executing image forming using a white color toner, in addition to individual developing devices (image forming units) of standard color toners.

Figure 2:
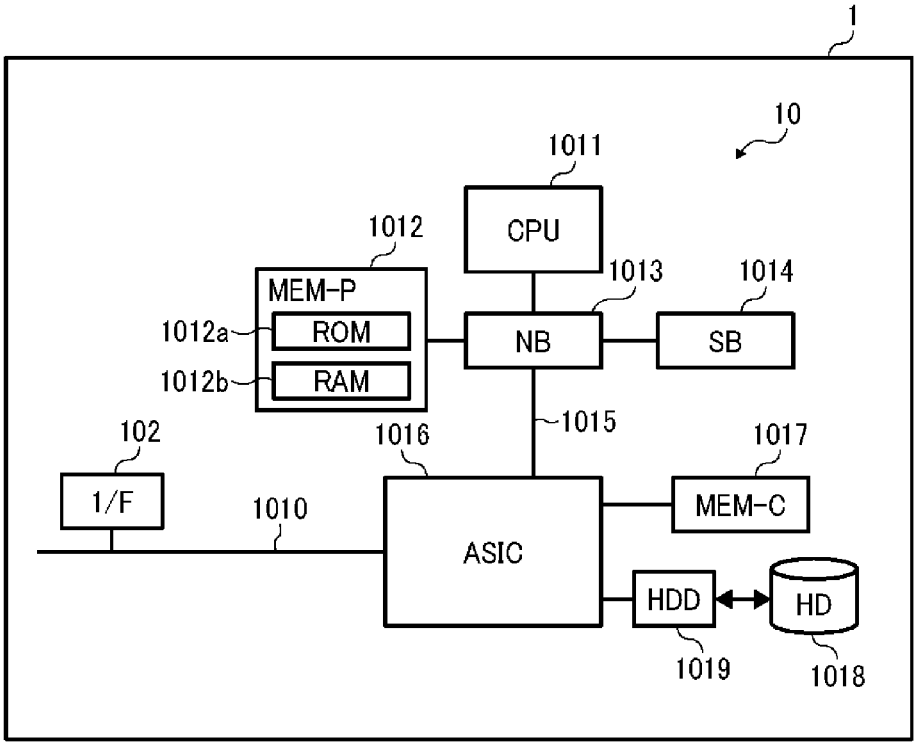
FIG. 2 is a schematic view of a configuration of hardware of a control of the image forming apparatus according to the first embodiment.

FIG. 1 is a schematic view of a configuration of hardware of the image forming apparatus 1 according to this embodiment. FIG. 2 is a schematic view of a configuration of hardware of a control 10 of the image forming apparatus 1.

The image forming apparatus 1 fixes a toner image on a sheet to be an example of a recording medium and forms an image. The image forming apparatus 1 has a control 10, an image reader 11, an imaging unit 12, a sheet feeder 13, a transfer unit 14, a fixing unit 15, a sheet ejector 16, and a display-and-control unit 17, as illustrated in FIG. 1.

<Control>

The control 10 has a central processing unit (CPU) 1011, a main memory (MEM-P) 1012, a Northbridge (NB) 1013, a Southbridge (SB) 1014, an accelerated graphics port (AGP) bus 1015, an application specific integrated circuit (ASIC) 1016, a local memory (MEM-C) 1017, a hard disk (HD) 1018, a hard disk drive (HDD) 1019, and a network interface (I/F) 102, as illustrated in FIG. 2.

The CPU 1011 processes and calculates data or controls operations of the image reader 11, the imaging unit 12, the sheet feeder 13, the transfer unit 14, the fixing unit 15, and the sheet ejector 16, according to a program stored in the main memory 1012. The main memory 1012 is a storage region of the control 10 and has a read only memory (ROM) 1012*a* and a random access memory (RAM) 1012*b*. The ROM 1012*a* is a storage memory of a program or data to realize each function of the control 10. The program stored in the ROM 1012*a* may be recorded as a file of an installable format or an executable format in a computer readable recording medium such as a compact disk-read only memory (CD-ROM), a floppy disk (FD), a compact disk-recordable (CD-R), and a digital versatile disc (DVD) and may be provided.

The RAM 1012*b* is used as a memory for drawing at the time of developing a program or data and memory print. The NB 1013 is a bridge to connect the CPU 1011 and the main memory (MEM-P) 1012, the SB 1014, and the AGP bus 1015. The SB 1014 is a bridge to connect the NB 1013 and a peripheral component interconnect (PCI) device and a peripheral device. The AGP bus 1015 is a bus interface for a graphics accelerator card suggested to speed up graphic processing.

The ASIC 1016 includes a PCI target, an AGP master, an arbiter (ARB) becoming a core of the ASIC 1016, a memory controller controlling the MEM-C 1017, and a plurality of direct memory access controllers (DMAC) performing rotation of image data by hardware logic. The ASIC 1016 is connected to an interface of a universal serial bus (USB) or an interface of IEEE1394 (Institute of Electrical and Electronics Engineers 1394) via a PCI bus 1010.

The MEM-C 1017 is a local memory used as an image buffer for copy and a code buffer. The HD 1018 is a storage device that accumulates image data, accumulates font data used at the time of print, and accumulates forms. The HDD 1019 controls reading or writing of data for the HD 1018, according to control of the CPU 1011. The network I/F 102 exchanges information with an external device such as an information processing apparatus via a communication network.

<Image Reader>

The image reader 11 optically reads an image recorded on a sheet and generates image data. Specifically, the image reader 11 exposes light to the sheet, receives reflection light thereof by a reading sensor such as a charge coupled devices (CCD) or a contact image sensor (CIS), and reads image data. The image data is information showing an image formed on a recording medium such as the sheet and is displayed using electrical color separation image signals showing individual colors of read (R), green (G), and blue (B).

The image reader 11 has an exposure glass 111 and a reading sensor 112, as illustrated in FIG. 1. The sheet on which the image is recorded is placed on the exposure glass 111. The reading sensor 112 reads image data of the image recorded on the sheet placed on the exposure glass 111.

<Imaging Unit>

The imaging unit 12 adheres a toner to a surface of an intermediate transfer belt 143 of the transfer unit 14 and forms an image (toner image), on the basis of the image data read by the image reader 11 or the image data received by the network I/F 102.

The imaging unit 12 includes an image forming unit 120C to form a toner image using a developer having a cyan (C) color toner, an image forming unit 120M to form a toner image using a magenta (M) color toner, an image forming unit 120Y to form a toner image using a yellow (Y) color toner, an image forming unit 120K to form a toner image using a black (K) color toner, and an image forming unit 120T to form a toner image using a clear (T) toner.

Hereinafter, one or more toners of the C color toner, the M color toner, the Y color toner, and the K color toner are called color toners. Each color toner (standard color toner) is a charged resin particle that contains a color material such as a pigment and a dye.

A clear toner is a colorless and transparent toner and is a resin particle enabling the color toner to be viewed, when the clear toner is adhered to the color toner adhered to the recording medium. In addition, the clear toner is a resin particle enabling the recording medium to be viewed, when the clear toner is adhered to the recording medium. The clear toner is generated by externally adding silicon dioxide ($SiO_2$) or titanium dioxide ($TiO_2$) to low molecular weight polyester resin. When an amount of the clear toner is an amount of a degree at which the recording medium or the color toner adhered to the recording medium can be viewed, the clear toner may include a color material.

Hereinafter, any image forming unit of the image forming unit 120C, the image forming unit 120M, the image forming unit 120Y, the image forming unit 120K, and the image forming unit 120T is represented as the "image forming unit 120".

The image forming unit 120C includes a developer container 121C, a photoconductor drum 122C, a charger 123C, an exposing unit 124C, a developing device 125C, a diselectrifier 126C, and a cleaner 127C.

The developer container 121C accommodates the C color toner and supplies the C color toner to the developing device 125C. The toner accommodated in the developer container 121C is supplied to the developing device 125C by a predetermined amount, when a conveyance screw in the developer container 121C is driven. In the photoconductor drum 122C, a surface is charged uniformly by the charger 123C and an electrostatic latent image is formed on the surface by the exposing unit 124C, on the basis of the image data received from the control 10. The developing device 125C adheres the toner to the surface of the photoconductor drum 122C on which the electrostatic latent image has been formed and a toner image is formed. The photoconductor drum 122C is provided to contact the intermediate transfer belt 143 and rotate in the same direction as a movement direction of the intermediate transfer belt 143 at a contact with the intermediate transfer belt 143.

The charger 123C charges the surface of the photoconductor drum 122C uniformly. The exposing unit 124C irradiates the surface of the photoconductor drum 122C charged by the charger 123C with light, on the basis of a halftone dot area ratio the C color determined by the control 10, and forms the electrostatic latent image on the surface. The developing device 125C adheres the toner of the C color accommodated in the developer container 121C to the electrostatic latent image formed on the surface of the photoconductor drum 122C by the exposing unit 124C, performs developing, and forms a toner image.

The diselectrifier 126C diselectrifies the surface of the photoconductor drum 122C after an image is transferred to the intermediate transfer belt 143. The cleaner 127C removes a transfer residual toner left on the surface of the photoconductor drum 122C diselectrified by the diselectrifier 126C.

The image forming unit 120M includes a developer container 121M, a photoconductor drum 122M, a charger 123M, an exposing unit 124M, a developing device 125M, a diselectrifier 126M, and a cleaner 127M. The developer container 121M accommodates the M color toner. Because the photoconductor drum 122M, the charger 123M, the exposing unit 124M, the developing device 125M, the diselectrifier 126M, and the cleaner 127M have the same functions as the photoconductor drum 122C, the charger 123C, the exposing unit 124C, the developing device 125C, the diselectrifier 126C, and the cleaner 127C, respectively, explanation thereof is omitted.

The image forming unit 120Y includes a developer container 121Y, a photoconductor drum 122Y, a charger 123Y, an exposing unit 124Y, a developing device 125Y, a diselectrifier 126Y, and a cleaner 127Y. The developer container 121Y accommodates the Y color toner. Because the photoconductor drum 122Y, the charger 123Y, the exposing unit 124Y, the developing device 125Y, the diselectrifier 126Y, and the cleaner 127Y have the same functions as the photoconductor drum 122C, the charger 123C, the exposing unit 124C, the developing device 125C, the diselectrifier 126C, and the cleaner 127C, respectively, explanation thereof is omitted.

The image forming unit 120K includes a developer container 121K, a photoconductor drum 122K, a charger 123K, an exposing unit 124K, a developing device 125K, a diselectrifier 126K, and a cleaner 127K. The developer container 121K accommodates the K color toner. Because the photoconductor drum 122K, the charger 123K, the exposing unit 124K, the developing device 125K, the diselectrifier 126K, and the cleaner 127K have the same functions as the photoconductor drum 122C, the charger 123C, the exposing unit 124C, the developing device 125C, the diselectrifier 126C, and the cleaner 127C, respectively, explanation thereof is omitted.

The image forming unit 120T includes a developer container 121T, a photoconductor drum 122T, a charger 123T, an exposing unit 124T, a developing device 125T, a diselectrifier 126T, and a cleaner 127T. The developer container 121T accommodates the clear toner. Because the photoconductor drum 122T, the charger 123T, the exposing unit 124T, the developing device 125T, the diselectrifier 126T, and the cleaner 127T have the same functions as the photoconductor drum 122C, the charger 123C, the exposing unit 124C, the developing device 125C, the diselectrifier 126C, and the cleaner 127C, respectively, explanation thereof is omitted.

Hereinafter, any developer container of the developer container 121C, the developer container 121M, the developer container 121Y, the developer container 121K, and the developer container 121T is represented as a "developer container" 121. In addition, any photoconductor drum of the photoconductor drum 122C, the photoconductor drum 122M, the photoconductor drum 122Y, the photoconductor drum 122K, and the photoconductor drum 122T is represented as a "photoconductor drum 122". In addition, any charger of the charger 123C, the charger 123M, the charger 123Y, the charger 123K, and the charger 123T is represented as a "charger 123". In addition, any exposing unit of the exposing unit 124C, the exposing unit 124M, the exposing unit 124Y, the exposing unit 124K, and the exposing unit 124T is represented as an "exposing unit 124". In addition, any developing device of the developing device 125C, the developing device 125M, the developing device 125Y, the developing device 125K, and the developing device 125T is represented as a "developing device 125". In addition, any diselectrifier of the diselectrifier 126C, the diselectrifier 126M, the diselectrifier 126Y, the diselectrifier 126K, and the diselectrifier 126T is represented as a "diselectrifier 126". In addition, any cleaner of the cleaner 127C, the cleaner 127M, the cleaner 127Y, the cleaner 127K, an the cleaner 127T is represented as a "cleaner 127".

The image forming unit 120T among the image forming units 120 can be replaced with a white color image forming unit 120W to be described below. In addition, the image forming apparatus 1 can be provided with both the image forming unit 120T and the white color image forming unit 120W.

<Sheet Feeder>

The sheet feeder 13 feeds a sheet to the transfer unit 14. The sheet feeder 13 includes a sheet tray 131, a sheet feed roller 132, a sheet feed belt 133, and registration rollers 134.

The sheet tray 131 accommodates a sheet to be an example of a recording medium. The sheet feed roller 132 is provided to rotate to move sheets accommodated in the sheet tray 131 to the sheet feed belt. The sheet feed roller 132 provided as described above individually extracts a sheet on an uppermost stage among the accommodated sheets and places the sheet on the sheet feed belt.

The sheet feed belt 133 conveys the sheet extracted by the sheet feed roller 132 to the transfer unit 14. The registration rollers 134 delivers the sheet conveyed by the sheet feed belt 133 at timing when a portion of the intermediate transfer belt 143 to be described below on which a toner image is formed arrives at the transfer unit 14.

<Transfer Unit>

The transfer unit 14 transfers (primarily transfers) the image formed on the photoconductor drum 122 by the imaging unit 12 to the intermediate transfer belt 143 and transfers (secondarily transfers) the image transferred to the intermediate transfer belt 143 to the sheet.

The transfer unit 14 includes a driving roller 141, a driven roller 142, the intermediate transfer belt 143, primary transfer rollers 144C, 144M, 144Y, 144K, and 144T, a secondary transfer roller 145, a secondary opposing roller 146, and a tension roller 147.

The driving roller 141 loops the intermediate transfer belt 143 with the driven roller 142. The driving roller 141 is driven and rotates, so that the looped intermediate transfer belt 143 moves. The driven roller 142 loops the intermediate transfer belt 143 with the driving roller 141. The driven roller 142 rotates when the driving roller 141 rotates and the intermediate transfer belt 143 moves.

The intermediate transfer belt 143 loops over the driving roller 141 and the driven roller 142 and moves while contacting the photoconductor drum 122, when the driving roller 141 rotates. The intermediate transfer belt 143 moves while contacting the photoconductor drum 122, so that the image formed on the photoconductor drum 122 is transferred to the surface of the intermediate transfer belt 143.

The primary transfer rollers 144C, 144M, 144Y, 144K, and 144T are provided to face the photoconductor drums 122C, 122M, 122Y, 122K, and 122T with the intermediate transfer belt 143 nipped therebetween, respectively, and rotate to move the intermediate transfer belt 143. The secondary transfer roller 145 rotates with the intermediate transfer belt 143 and the sheet nipped between the secondary opposing roller 146 and the secondary transfer roller. The secondary opposing roller 146 rotates with the intermediate transfer belt 143 and the sheet nipped between the secondary transfer roller 145 and the secondary opposing roller 146.

<Fixing Unit>

The fixing unit 15 fixes the toner transferred to the sheet by the transfer unit 14. The fixing means that heat and pressure are applied to the toner at the same time to adhere a resin component of the toner to the sheet. Fixing processing is executed on the toner transferred to the sheet by the transfer unit 14, so that a state of the toner on the sheet is stabilized.

The fixing unit 15 has a conveyance belt 151, a fixing belt 152, a fixing roller 153, a fixing-belt conveyance roller 154, a fixing opposing roller 155, and a heater 156. The conveyance belt 151 conveys the sheet to which the toner has been transferred by the transfer unit 14 to the fixing roller 153 and the fixing opposing roller 155. The fixing belt 152 loops over the fixing roller 153 and the fixing-belt conveyance roller 154 and moves when these rollers rotate. The fixing roller 153 nips the sheet conveyed to the conveyance belt 151 between the fixing opposing roller 155 disposed to face the fixing roller 153 and the fixing roller 153, and heats and presses the sheet.

The fixing-belt conveyance roller 154 loops the fixing belt 152 with the fixing roller 153. The fixing-belt conveyance roller 154 rotates to move the fixing belt 152. The fixing opposing roller 155 is disposed to face the fixing roller 153 and nips the conveyed sheet between the fixing roller 153 and the fixing opposing roller 155. The heater 156 is disposed in the fixing roller 153 and emits heat. The heater 156 heats the sheet via the fixing roller 153.

<Sheet Ejector>

The sheet ejector 16 ejects the sheet on which the toner has been fixed by the fixing unit 15, from the image forming apparatus 1, and has a sheet ejection belt 161, a sheet ejection roller 162, a sheet ejection port 163, and a sheet tray 164.

The sheet ejection belt 161 conveys the sheet on which the fixing processing has been executed by the fixing unit 15 to the sheet ejection port 163. The sheet ejection roller 162 ejects the sheet conveyed by the sheet ejection belt 161 from the sheet ejection port 163 and accommodates the sheet in the sheet tray 164. The sheet tray 164 accommodates the sheet ejected by the sheet ejection roller 162.

<Display and Control Unit>

The display-and-control unit 17 has a panel display 171 and a control unit 172. On the panel display 171, a setting value or a selection screen is displayed. In addition, the panel display 171 is a touch panel that receives an input from an operator. The control unit 172 is a unit, such as a numeric keypad receiving conditions regarding image forming and a start key receiving a copy start instruction, operated by a user to perform an input.

The image forming apparatus 1 having the configuration illustrated in FIG. 1 can further have the white color image forming unit 120W, instead of the image forming unit 120T. In an image forming apparatus (hereinafter, called 1A conveniently) in which the white color image forming unit 120W is added and an image is formed on translucent media using the standard color toners and the white color toner, when the image is viewed from a surface (translucent media side) opposite to an imaging surface on the translucent media, the white color toner becomes an uppermost layer in the imaging surface, a background image is not translucent, and a print material of a high added value that is uniformly glossy by a glossy feeling of the translucent media can be generated. When such an image is generated with one pass, in the case of an intermediate transfer system, order of toner layers on the intermediate transfer belt and the transfer media is changed. For this reason, it is necessary to dispose a white color toner developing unit of the imaging unit on an uppermost stream of a conveyance direction D1 of the intermediate transfer belt 143 (refer to FIG. 3). In addition, in the case of a direct transfer system, it is necessary to dispose the white color image forming unit 120W on a lowermost stream. Imaging order of the standard color toners may not be designated particularly. The white color toner image can be formed on a lowermost layer of the imaging surface. In this case, the white color image forming unit 120W may be disposed on the lowermost stream and the uppermost stream in the intermediate transfer system and the direct transfer system, respectively.

Figure 3:
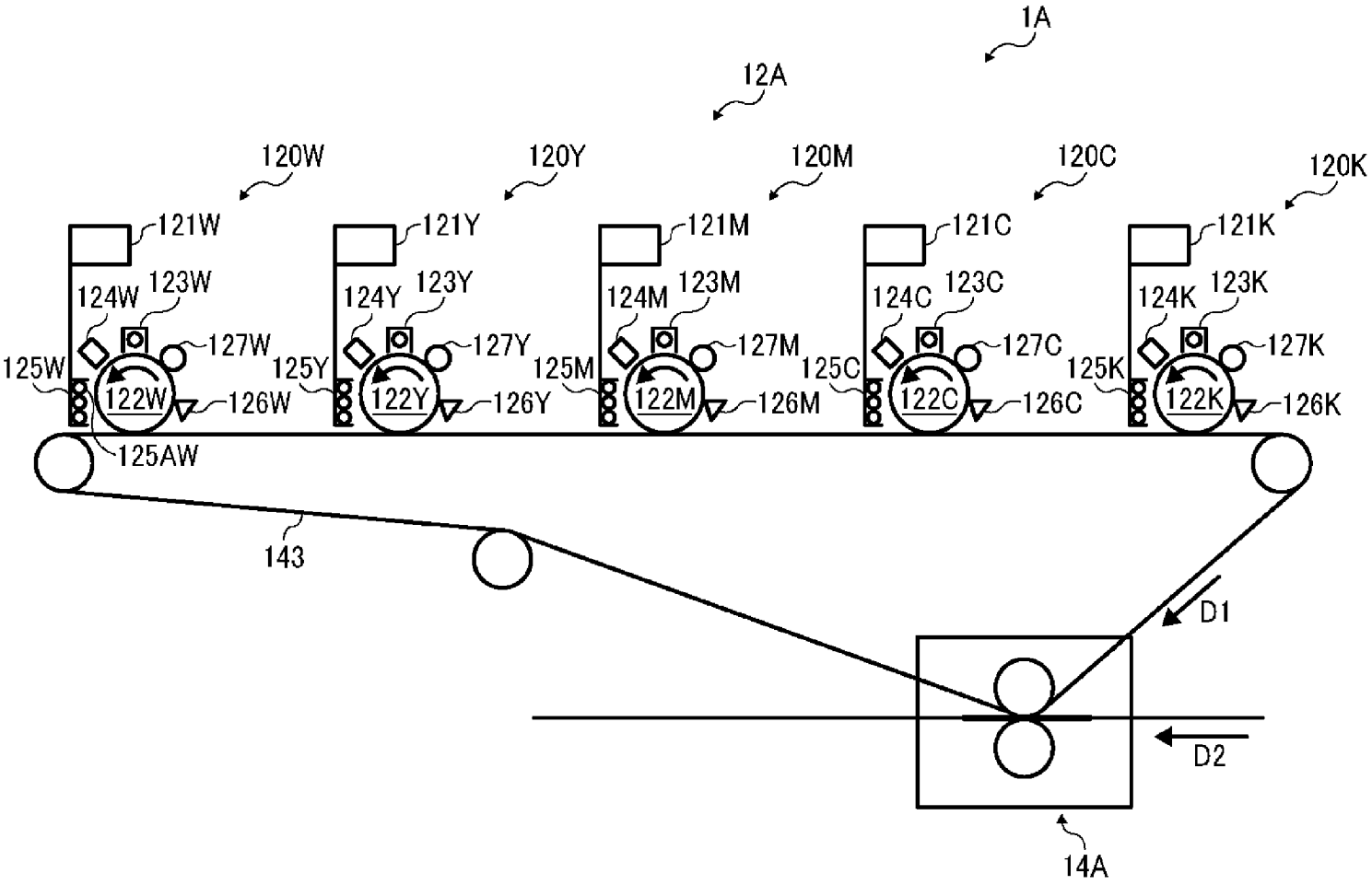
FIG. 3 is an illustration of an arrangement aspect of a white color image forming unit of the image forming apparatus according to the first embodiment.
Figure 4:
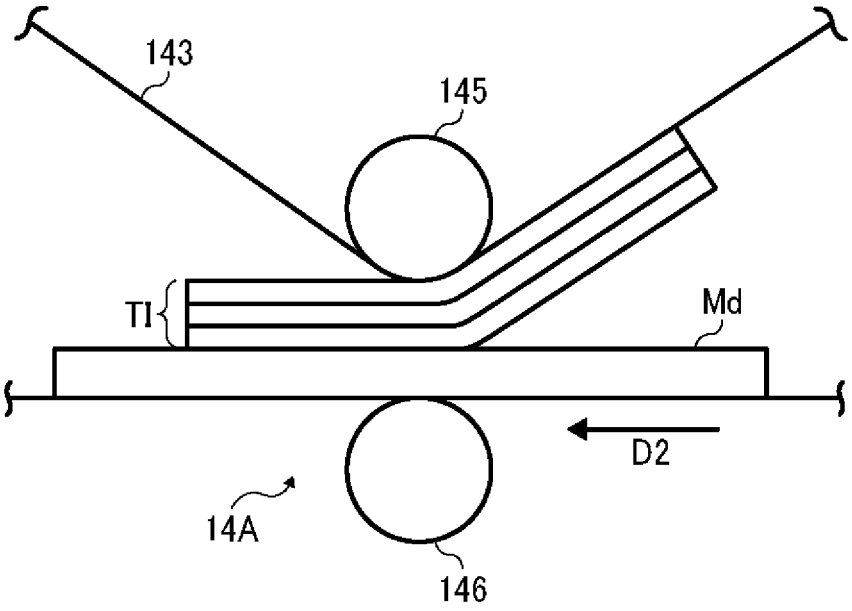
FIG. 4 is an enlarged illustration of a configuration of a transfer unit of FIG. 3.

FIG. 3 is an illustration of an arrangement aspect of the white color image forming unit 120W in an imaging unit 12A of the image forming apparatus 1A according to this embodiment. FIG. 3 illustrates an arrangement example in the intermediate transfer system in particular. FIG. 4 is an enlarged illustration of a configuration of a transfer unit 14A of FIG. 3.

In a configuration of the imaging unit 12A of the image forming apparatus 1A illustrated in FIG. 3, the white color image forming unit 120W is adjacent to the individual standard-color image forming units 120Y, 120M, 120C, and 120K and is disposed on the uppermost stream side of the conveyance direction D1 of the intermediate transfer belt 143. The white color image forming unit 120W forms a white color toner image using a developer having a white (W) color toner. Similar to the other image forming units 120Y, 120M, 120C, and 120K, the white color image forming unit 120W includes a developer container 121W, a photoconductor drum 122W, a charger 123W, an exposing unit 124W, a developing device 125W, a diselectrifier 126W, and a cleaner 127W. A developing sleeve 125AW is provided in the developing device 125W. The developing sleeve 125AW is disposed to face a circumferential surface of the photoconductor drum 122W and supplies a white color toner in the developing device 125W to the surface of the photoconductor drum 122W while rotating with a predetermined rotation ratio with the photoconductor drum 122W. The white color image forming unit 120W can adjust developing performance by changing the rotation ratio of the developing sleeve 125AW and the photoconductor drum 122W or changing an amount (toner density) of the white color toner among the developers refilled into the developing device 125W.

In the imaging unit 12A, in an image forming process for adding a white color toner image to each toner image of standard color, a white (W) color toner image, a yellow (Y) color toner image, a magenta (M) color toner image, a cyan (C) color toner image, and a black (K) color toner image are transferred to the intermediate transfer belt 143 in order of the image forming units 120W, 120Y, 120M, 120C, and 120K.

Next, as illustrated in FIG. 4, in the transfer unit 14A of the imaging unit 12A, the toner images TI of the individual colors and the white color formed to be superimposed on the intermediate transfer belt 143 are transferred to a recording medium Md composed of a translucent medium, fed in a direction indicated by D2, in a superimposition order opposite to a superimposition order at the time of the primary transfer. As a result, the toner images TI superimposed in order of the black (K) color toner image, the cyan (C) color toner image, the magenta (M) color toner image, the yellow (Y) color toner image, and the white (W) color toner image are transferred to the recording medium Md.

In the image forming apparatus 1A, processing for adjusting a white color toner adhesion amount of the white color toner image on the basis of setting of white color toner brightness from the user can be executed in the image forming process. As usual, density adjustment can be performed by process control executed at predetermined timing, for the individual standard color toner images of yellow (Y), magenta (M), cyan (C), and black (K).

Here, a method of adjusting densities (that is, toner adhesion amounts) of the standard color toner images and the white color toner image in the image forming apparatus 1A will be described.

A toner adhesion amount on the sheet (recording medium Md) is controlled by adjusting a toner developing amount on the photoconductor (photoconductor drum 122). A relation of the toner developing amount on the photoconductor and the developing potential is illustrated in FIG. 5.

Figure 5:
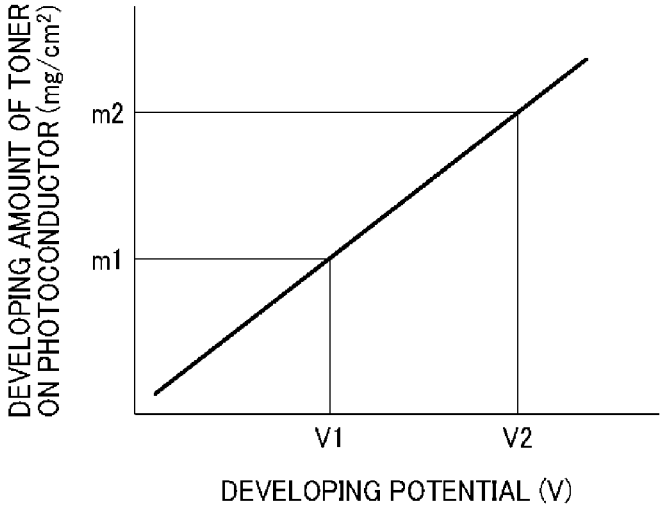
FIG. 5 is a characteristic diagram of a toner developing amount versus a developing potential applied to standard color toner adhesion amount adjustment processing.

That is, FIG. 5 is a graph illustrating a characteristic of a toner developing amount versus a developing potential applied to standard color toner adhesion amount adjustment processing of the image forming apparatus 1A according to this embodiment.

The toner developing amount on the photoconductor and the developing potential (that is, a potential difference of a surface potential of a photoconductor dark area and a potential (developing bias potential) of a developing sleeve) are in a correlative relation and a toner developing amount on the photoconductor is adjusted by increasing or decreasing the developing potential. For example, to obtain developing amounts m1 and m2, developing potentials V1 and V2 are necessary, respectively. An inclination (inclination of a line showing a relation of the toner developing amount and the developing potential) shows developing performance of a system.

Generally, the developing performance of the image forming unit 120 can be adjusted by increasing or decreasing the developer toner density in the developing device 125. However, when the density of the standard color toner is adjusted, the inclination is set to an optimal fixed value of the system to stably provide a high-quality image (from the viewpoint of reproducibility first of an image).

However, if the inclination is constant, it is not possible to obtain a further toner developing amount when the developing potential reaches an upper limit (mainly determined from a power/electric specification or an abnormal image) and it is not possible to correspond to when a further adhesion amount increase is requested from the user.

Therefore, in the image forming apparatus 1A according to this embodiment, for the standard color toners, the density is adjusted on the basis of the relation of the toner developing amount on the photoconductor and the developing potential illustrated in FIG. 5. Meanwhile, in brightness adjustment (toner adhesion amount adjustment) of the white color toner, an optical developing condition to be previously stored is selected on the basis of an adhesion amount change request (brightness setting value of the white color toner) designated from the user and a developing-performance adjustment operation of the white color image forming unit 120W is executed, so that it is possible to a wide adhesion amount change request of the white color toner.

In this embodiment, a variable range of the white color toner adhesion amount by adjustment of the developing performance of the white color image forming unit 120W is controlled to be wider than a variable range of the standard color toner adhesion amount. In addition, it is assumed that a white color toner adhesion amount setting value (white color toner brightness setting value) regarding adjustment of the developing performance of the white color image forming unit 120W and a standard color toner adhesion amount setting value are independent from each other and do not conflict with each other.

Next, a relation of a white color toner adhesion amount and brightness in the image forming apparatus 1A according to this embodiment will be described with reference to FIG. 6.

Figure 6:
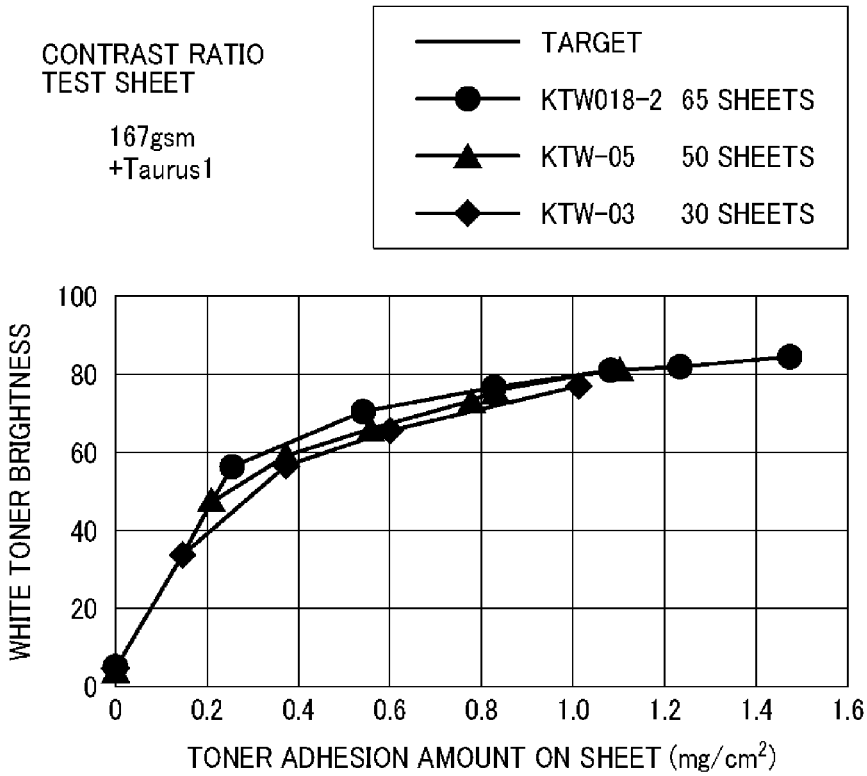
FIG. 6 is a characteristic diagram of a toner adhesion amount versus brightness of a white color toner image formed on a contrast-ratio test sheet.

FIG. 6 is a characteristic diagram of a white color toner adhesion amount versus a brightness of a white color toner image formed on a contrast-ratio test sheet. FIG. 6 illustrates an example of a white solid image when a white color toner is placed on a contrast-ratio test sheet having a white side having visible reflectance of 802±2 and a black side having visible reflectance of 5 or less in an image area ratio of 100%. In this embodiment, adhesion processing of the white color toner amount according to the brightness setting value from the user is executed according to the characteristic of the toner adhesion amount versus the brightness of the white color toner image formed on the contrast-ratio test sheet.

If the characteristic illustrated in FIG. 6 is analyzed, it is known that the adhesion amount increases, the adhesion amount increases, a contrast ratio of a sheet by the white color toner increase, an influence of a black sheet of a background is alleviated, and brightness increases. This is the same in the case in which the background is a general color image. The brightness increases when the adhesion amount of the white color toner increases, decorativeness when letters, logos, textures, special patterns, and molding patterns are loaded on a color image by the white color toner increases, and formation of an image having a high added value as a print material is enabled.

In this embodiment, print media are not limited to the sheets and may be translucent media such as translucent package films, for example. When an image is printed on the translucent media, there are many cases in which the white color toner is buried under the color image such that the image is not translucent and print is performed. In this case, a contrast ratio of the translucent media by the white color toner becomes important. When the adhesion amount is small and does not satisfy a required amount, the color image is translucent and formation of an image having a high added value is disabled. If the user inputs a desired white color toner brightness setting value for the print material to the image forming apparatus 1A, a required amount of the white color toner is calculated on the basis of the characteristic diagram of the relation of the white color toner adhesion amount and the brightness illustrated in FIG. 6 and print in which the required amount is achieved is executed.

<Control>

Figures 7, 8:
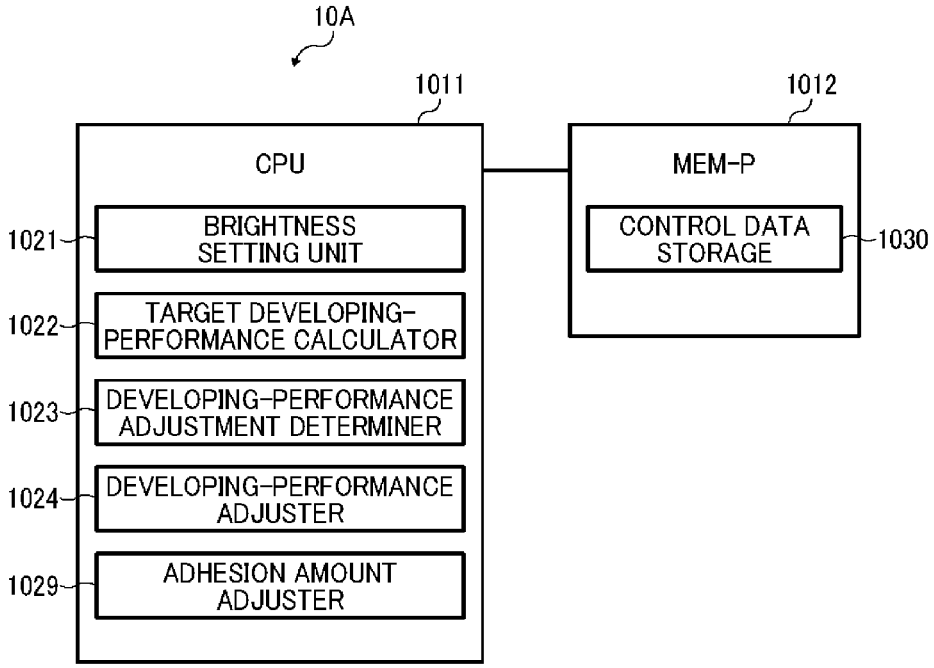
FIG. 7 is a block diagram of a configuration of the control of the image forming apparatus according to the first embodiment.
FIG. 8 is a table illustrating a registration example of mode definition parameters defining a mode when white color toner brightness is adjusted.

FIG. 7 is a block diagram of a configuration of a control 10A of the image forming apparatus 1A according to this embodiment.

As illustrated in FIG. 7, the control 10A of the image forming apparatus 1A is configured by including a brightness setting unit 1021, a target developing-performance operation unit 1022, a developing-performance adjustment determiner 1023, a developing-performance adjuster 1024, and an adhesion amount adjuster 1029 in a CPU 1011 to be a main control.

The developing-performance adjuster 1024 changes an amount of a white color toner among developers refilled into the developing device 125W of the white color image forming unit 120W and a sleeve linear velocity while referring to control information registered in a control-data storage 1030 provided in a main memory 1012 and executes control to adjust developing performance (sensitivity of the toner developing amount for the developing bias) of the white color image forming unit 120W. The adhesion amount adjuster 1029 changes the developing bias between the photoconductor drum 122W and the developing sleeve in the developing device 125W in the white color image forming unit 120W and adjusts the white color toner developing amount on the sheet. As a result of adjustment of the white color toner developing amount, brightness of the white color toner image on the sheet is adjusted. Therefore, the adhesion amount adjuster 1029 realizes a brightness adjustment function of the white color toner image. The adhesion amount adjuster 1029 can execute adjustment processing of the toner developing amount in the other image forming units 120Y, 120M, 120C, and 120K.

FIG. 8 is a table illustrating a registration example of a mode definition parameter defining modes at the time of adjusting the brightness of the white color toner. Mode definition parameters 1031 can be stored previously in the control-data storage 1030. In the example illustrated in FIG. 8, to correspond to a plurality of adhesion amount divisions (modes) having different white color toner adhesion amounts, a threshold value of the adhesion amount of the white color toner used to determine each adhesion amount mode, an optimal developing performance (developing γ) setting value for each adhesion amount mode, and a target velocity ratio regarding a developing sleeve velocity ratio change function to be a developing-performance adjustment control are associated and registered as the mode definition parameters 1031.

FIG. 9 is a table illustrating a registration example of a white color toner brightness adjustment control parameter. White color toner brightness adjustment control parameters 1032 can be stored in the control-data storage 1030 by referring to the characteristic data in FIG. 8, based on white color toner brightness setting by the user and a setting value thereof, before a print job. In the example illustrated in FIG. 9, as the white color toner brightness adjustment control parameters 1032, brightness of the white color toner is divided into five divisions and an adhesion amount on the sheet, an adhesion amount division selection result, a developing γ setting value, and a developing sleeve velocity ratio are registered to correspond to each division.

The mode definition parameter (refer to FIG. 8) and the brightness adjustment control parameter (refer to FIG. 9) are stored in the control-data storage 1030 and in the image forming apparatus 1A, an input of a setting value of the white color toner brightness of a maximum of L*=85 for brightness L* of a Lab color space from the user by the brightness setting unit 1021 is received and the developing-performance adjuster 1024 can execute developing-performance adjustment control to realize the toner adhesion amount corresponding to the white color toner brightness setting value.

Figure 10:
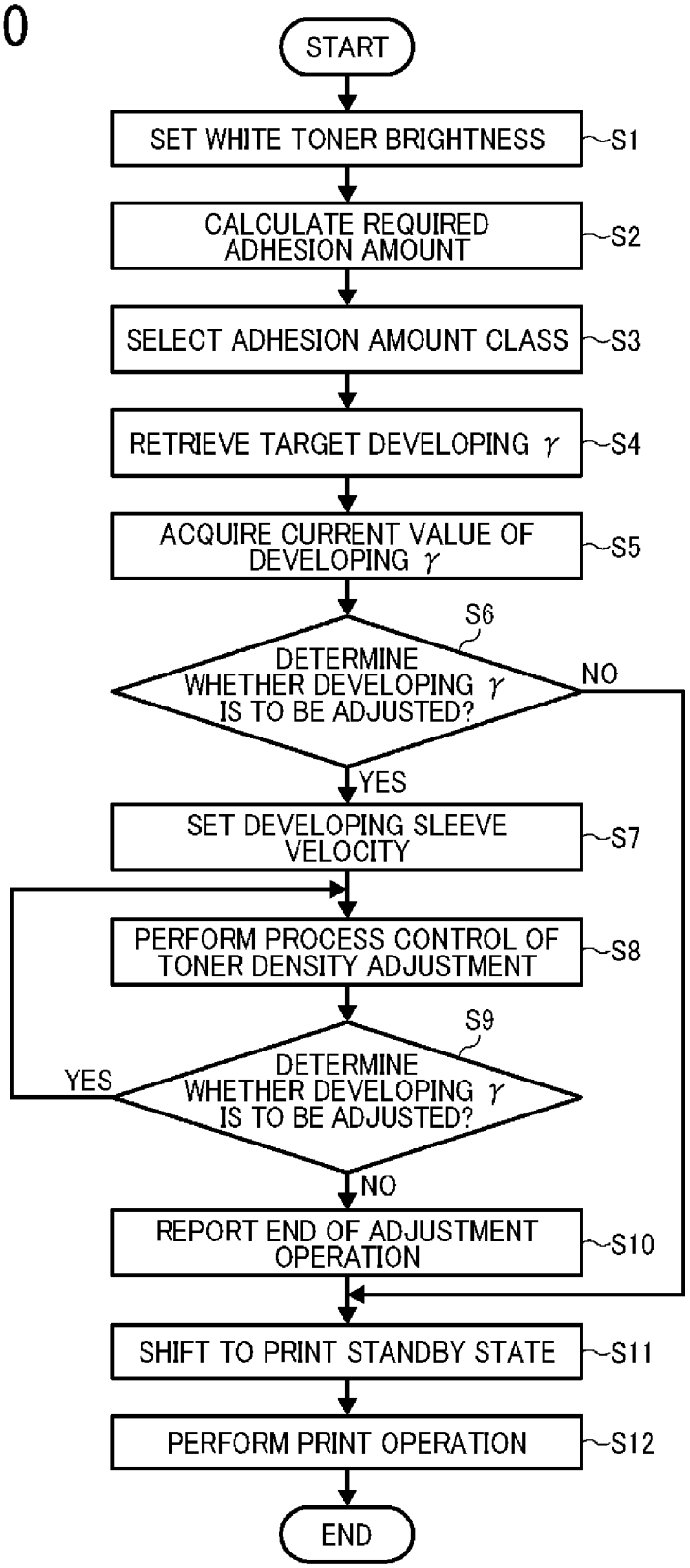
FIG. 10 is a flowchart illustrating white color toner brightness adjustment processing of the image forming apparatus according to the first embodiment.

FIG. 10 is a flowchart illustrating white color toner adhesion amount adjustment processing of the image forming apparatus 1A according to this embodiment.

The processing starts when the user displays a setting screen on a panel display 171 of the display-and-control unit 17, inputs a desired setting value of the brightness of the white color toner from the control unit 172, and executes an instruction operation of a processing start.

If the user sets the white color toner brightness for a print job to be printed on the setting screen and inputs an instruction of the start, in the control 10A, a brightness setting unit 1021 receives the input of the setting value of the white color toner brightness and sets the white color toner brightness (step S1).

Next, the target developing-performance operation unit 1022 calculates a necessary white color toner adhesion amount corresponding to the white color toner brightness setting value in step S1 by referring to the mode definition parameters 1031 illustrated in FIG. 8 (step S2) and determines a threshold value of the calculated necessary white color toner adhesion amount and selects a corresponding adhesion amount division (mode) (step S3).

In the mode definition parameters 1031 illustrated in FIG. 8, developing γ necessary to perform developing with the white color toner adhesion amount in each adhesion amount mode and a developing sleeve velocity ratio are set previously to each adhesion amount division (mode). As a result, the target developing-performance operation unit 1022 refers to (specifies) the setting value of developing γ of the mode definition parameters 1031 corresponding to the adhesion amount mode selected in step S3 as target developing γ (step S4) and confirms a current value of developing γ (step S5).

Next, the developing-performance adjustment determiner 1023 calculates a difference of the setting value of developing γ referred to by the target developing-performance operation unit 1022 and the current value of developing γ and determines whether it is necessary to execute an adjustment operation of developing γ, on the basis of a difference value thereof (step S6).

Here, when it is determined that it is unnecessary to execute the adjustment operation of developing γ (unnecessary in step S6), the process enters a printing ready state (step S11). Meanwhile, when it is determined that it is necessary to execute the adjustment operation of developing γ (necessary in step S6), the developing-performance adjuster 1024 adjusts the velocity of the developing sleeve in the developing device 125W of the white color image forming unit 120W to the developing sleeve velocity ratio (rotation velocity ratio to the photoconductor drum 122W) set to correspond to the adhesion amount division (mode) selected in step S3 (step S7). Then, the developing-performance adjuster 1024 executes toner density adjustment process control (step S8), changes a developer toner density in the white color image forming unit 120W, and adjusts developing γ to a setting value.

After the toner density adjustment process control in step S8 ends, the developing-performance adjustment determiner 1023 redetermines whether it is unnecessary to execute the adjustment operation of developing γ (step S9). Here, when it is determined that it is unnecessary to execute the adjustment operation of developing γ (unnecessary in step S9), the main control (CPU 1011) transmits that the adjustment operation has ended (step S10) and enters a printing ready state (step S11). Then, the main control executes a print operation using developing γ adjusted in step S6 or S9 (step S12). In the print operation, the adhesion amount adjuster 1029 changes the developing bias under print control by the main control (specifically, a print controller) and executes processing for adjusting the brightness of the white color toner image by adjusting the adhesion amount of the white color toner on the sheet.

According to the white color toner adhesion amount (brightness) adjustment processing illustrated in FIG. 10, when a print job including white color toner image data is executed, the user inputs a desired white color toner brightness setting value, so that a print material in which the white color toner of an amount corresponding to the setting value is adhered to an electrostatic latent image of the white color toner image data on the basis of the white color toner brightness setting value can be obtained.

In the white color toner adhesion amount adjustment processing illustrated in FIG. 10, in step S9, developing γ is adjusted by adjusting the velocity ratio of the developing sleeve of the developing device 125W of the white color image forming unit 120W. That is, the developing-performance adjuster 1024 is realized by a velocity ratio adjustment function of the developing sleeve.

Figure 11:
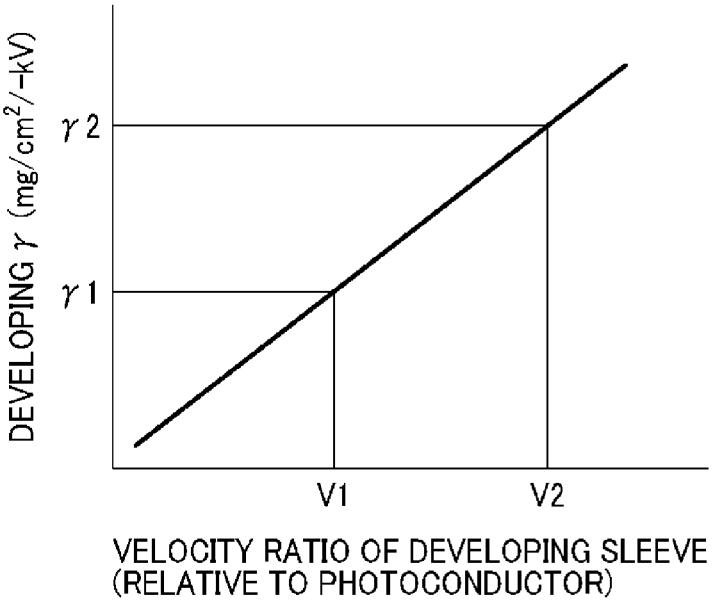
FIG. 11 is a characteristic diagram of developing sleeve velocity versus developing performance applied to the white color toner brightness adjustment processing.

FIG. 11 is a graph illustrating a relation of developing γ and a developing sleeve velocity ratio applied to the white color toner adhesion amount adjustment processing. The developing sleeve velocity ratio illustrated in FIG. 11 is represented by a ratio (developing sleeve/photoconductor) of surface velocities of the developing sleeve and the photoconductor drum 122W of the white color image forming unit 120W. A velocity ratio of 1.0 shows that the surface velocities of the developing sleeve and the photoconductor drum 122W are the same and a velocity ratio of 1.0 or more shows that the developing sleeve is faster than the photoconductor drum 122W. If the developing sleeve velocity ratio increases, a velocity difference of the developer in a developing region and the surface of the photoconductor drum 122W increases, developing performance is increased by a sliding effect of the surface of the photoconductor drum 122W by the developer, and developing γ increases.

As a mechanism for adjusting developing γ (developing-performance adjuster 1024), in addition to changing and adjusting the developing sleeve velocity ratio according to developing γ, according to the characteristic illustrated in FIG. 11, a method of changing and adjusting a developer toner density (toner supply amount: wt %) in the developing device 125 of the white color image forming unit 120W according to developing γ is also known.

Figure 12:
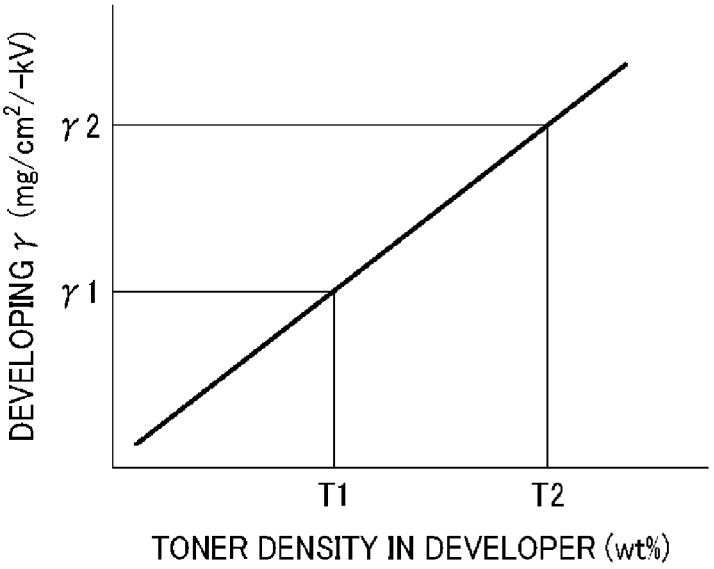
FIG. 12 is a characteristic diagram of a developing toner density versus developing performance applied to the white color toner brightness adjustment processing.

FIG. 12 is a graph illustrating a relation of developing γ and a developer toner density applied to the white color toner adhesion amount adjustment processing. As illustrated in FIG. 12, if the toner density of the developer increases, a charging amount of the toner decreases and the toner is easily developed. In addition, because a toner amount in the developing region increases, the toner is easily supplied to the surface of the photoconductor drum 122W, the developing performance increase, and developing γ increases. Such a developer toner density adjustment function can be realized by storing data (control data) showing the characteristic illustrated in FIG. 12 in the control-data storage 1030 (refer to FIG. 7) provided in the main memory 1012.

As described above, both the developing sleeve velocity ratio adjustment function and the developer toner density adjustment function are effective for adjustment of developing γ in the image forming apparatus 1A. However, because sensitivity is large in the developing sleeve velocity ratio adjustment function, to use the developing sleeve velocity ratio adjustment mainly and use the developer toner density adjustment secondarily is considered. For example, an optimal developing sleeve velocity ratio may be set previously to the developing γ setting value of each adhesion amount division, the white color toner brightness may be greatly adjusted with the developing sleeve velocity ratio, and developing γ adjustment by the toner density may be performed as fine tuning. As such, in the white color toner adhesion amount adjustment, both functions may be used individually or may be used together.

In addition to the method of directly inputting the desired white color toner setting value on the setting screen, the following method can be applied to setting processing of the white color toner of step S1 in the white color toner adhesion amount adjustment processing illustrated in FIG. 10.

<Notch Adjustment>

The user performs adjustment by a notch in stages while confirming a print result of a print material. The user can perform adjustment by an operation (for example, a touch panel operation) on a print setting screen and displayed on the panel display 171 and the control unit 172 in the display-and-control unit 17 of the image forming apparatus 1A. In addition, the notch may be executed by an instruction from an external information processing terminal. The notch adjustment is effective for the case in which the white color toner brightness is finely tuned on the basis of a balance with print media or a standard color image.

<Mode Selection>

Any one of the adhesion amount divisions (modes) set previously to the image forming apparatus 1A is selected. The adhesion amount mode can be selected by an operation from the display-and-control unit 17 of the image forming apparatus 1A and can be selected from a print setting screen in an external information processing terminal or a panel of a printer. The mode selection is effective for the case in which the brightness of the white color toner is greatly changed simply and easily. A user setting frame is provided and a desired value can be registered.

<User Setting Sheet Registration>

In the image forming apparatus 1A, a maker recommendation value for each of representative sheet brands/print media is initially registered and the user selects the brand by an operation from the display-and-control unit 17 of the image forming apparatus 1A and can input an optimal white color toner brightness setting value. FIG. 13 is a table illustrating a brightness adjustment value setting example for each sheet used for white color toner brightness setting.

In the example illustrated in FIG. 13, items such as "sheet feeding", "conveyance", "image position/scaling", "driving system", and "imaging system" exist as setting value adjustment items associated with the recording media (sheets). For the recording media illustrated in FIG. 13, an item regarding image density adjustment is provided in the item of "imaging system" among the items and at least "standard color image density" and "white color toner brightness" can be set.

In FIG. 13, because the registered values are only the recommendation values, the user can change the registration values to desired values according to a use. When the same brands/media are used at a plurality of different brightness for each print use, registration is performed for each condition like "a brand A is a brightness 1" and "a brand B is a brightness 2" and a print condition can be set simply and easily.

By storing brightness adjustment data for each sheet in FIG. 13 as control data, when a print job including a white color toner image is executed, the sheet selection screen is displayed on the panel display 171 in processing of step S1 of FIG. 10, the control unit 172 is operated, and a desired sheet (recording medium) can be selected. As a result, the "white color toner brightness" set to the "image density adjustment" item of the sheet selected by the user is automatically taken in a system as a required value.

In the control 10A, the brightness setting unit 1021 takes the required value of the white color toner and stores the required value as the white color toner brightness setting value. Hereinafter, the brightness setting unit 1021 executes each color toner adhesion amount adjustment processing after step S2 of FIG. 10, on the basis of the white color toner brightness setting value. In this case, the user does not need to directly input and set the white color toner brightness in step S1.

In this embodiment, the user sets the white color toner brightness and executes the toner adhesion amount adjustment processing. However, the white color toner adhesion amount in the print job may be extracted by a job analyzer (equal to the job analyzer 1025 illustrated in FIG. 14), the threshold value of the extracted white color toner adhesion amount may be determined, the adhesion mode may be determined, the adjustment operation of the developing performance may be executed to be matched with the developing-performance setting value of the adhesion mode, and the imaging process may be executed.

As described above, in the image forming apparatus 1A according to this embodiment, the developing-performance adjuster 1024 adjusts the developing performance of the white color image forming unit 120W to a developing performance different from the developing performance fixedly applied to the individual standard-color image forming units 120Y, 120M, 120C, and 120K according to the setting value of the brightness of the white color toner in the brightness setting unit 1021. For this reason, the adhesion amount (brightness) of the white color toner may be adjusted in a wide range without depending on the density adjustment range of the standard color toner, according to setting of the white color toner brightness.

In addition, in the image forming apparatus 1A according to this embodiment, the developing-performance adjuster 1024 uses one of the function of changing the surface velocity ratio of the developing sleeve and the photoconductor drum of the white color image forming unit 120W on the basis of the white color toner brightness setting value and a function of changing the toner density of the white color toner in the developer, or both the functions and adjusts the developing performance. For this reason, it is possible to correspond to wide developing-performance adjustment by using a plurality of developing-performance adjusters together.

In addition, in the image forming apparatus 1A according to this embodiment, the developing-performance adjuster 1024 associates the plurality of adhesion amount modes in which the threshold values of the white color toner adhesion amounts are different and the optimal developing-performance setting values for every adhesion amount mode and retains the association in the control-data storage 1030 previously. The developing-performance adjuster 1024 determines the threshold value of the white color toner adhesion amount in the print job identified by the job analyzer 1025, selects any one of the adhesion amount modes, and adjusts the developing performance of the white color image forming unit 120W to be matched with the developing-performance setting value corresponding to the selected adhesion amount mode. For this reason, feed forward processing is enabled by storing the optimal values previously and an operation (repetition of the operation) for adjusting the developing performance and confirming the special color toner adhesion amount is unnecessary, which results in contributing to downtime reduction.

In addition, the image forming apparatus 1A according to this embodiment determines the threshold value of the white color toner adhesion amount calculated on the basis of the white color toner bright setting value by the brightness setting unit 1021, selects any one of the adhesion amount modes, and adjusts the developing performance of the white color image forming unit 120W to be matched with the developing-performance setting value corresponding to the selected adhesion amount mode. For this reason, it is possible to correspond to automatic adjustment of the developing performance when the white color toner adhesion amount is adjusted by the user.

In addition, the image forming apparatus 1A according to this embodiment has the control-data storage 1030 to be a storage device to store the brightness data of the white color toner set for each type of the sheet. The brightness setting unit 1021 sets the white color toner brightness on the basis of the brightness data set to correspond to the type of the sheet set by the user. For this reason, the optimal special color toner adhesion amount for each sheet is provided to the user, the user can designate the target brightness by only a selection operation of the sheet, and convenience of the system is improved.

In addition, in the image forming apparatus 1A according to this embodiment, the variable range of the white color toner adhesion amount by adjustment of the developing performance is wider than the variable range of the standard color toner adhesion amount. For this reason, a special color toner system in which an adjustment width of the white color toner brightness is large and versatility is high can be provided.

In addition, in the image forming apparatus 1A according to this embodiment, the white color toner adhesion amount setting value by adjustment of the developing performance of the white color image forming unit 120W and the standard color toner adhesion amount setting value are independent from each other and do not conflict with each other. For this reason, a print material of a high added value in which decoration by a special color toner image of a high brightness is executed while a full-color color reproduction range by a standard color toner is secured can be provided.

In addition, in the image forming apparatus 1A according to this embodiment, adjustment of the developing performance of the white color image forming unit 120W is setting that is available for a white brightness L*=80 or more on a contrast-ratio test sheet having a white side having visible reflectance of 802±2 and a black side having visible reflectance of 5 or less in an image area ratio of 100%. For this reason, a print material of a high added value in which the decoration by the special color toner image of the high brightness is executed can be provided.

Second Embodiment

In the image forming apparatus 1A according to the first embodiment, as the example of the print job in which the white color toner image is printed, a plurality of jobs in which the different white color toner adhesion amount (white color toner image density value) is set for each type of the print media (for example, a white general sheet, a translucent film, and a metallic/color sheet) or the different white color toner adhesion amount is different in the print surface of the same print media according to the use of the user are mixed.

As such, when a mixed print job (refer to FIG. 16) in which different types of print media and different white color toner adhesion amounts (density values) are set are mixed is processed, it is required to achieve a white color toner adhesion amount set for each of the mixed jobs (that is, each of pages).

This embodiment is adapted to adjustment of a white color toner adhesion amount of this type of mixed print job and a configuration and an operation thereof are described hereinafter.

Figure 14:
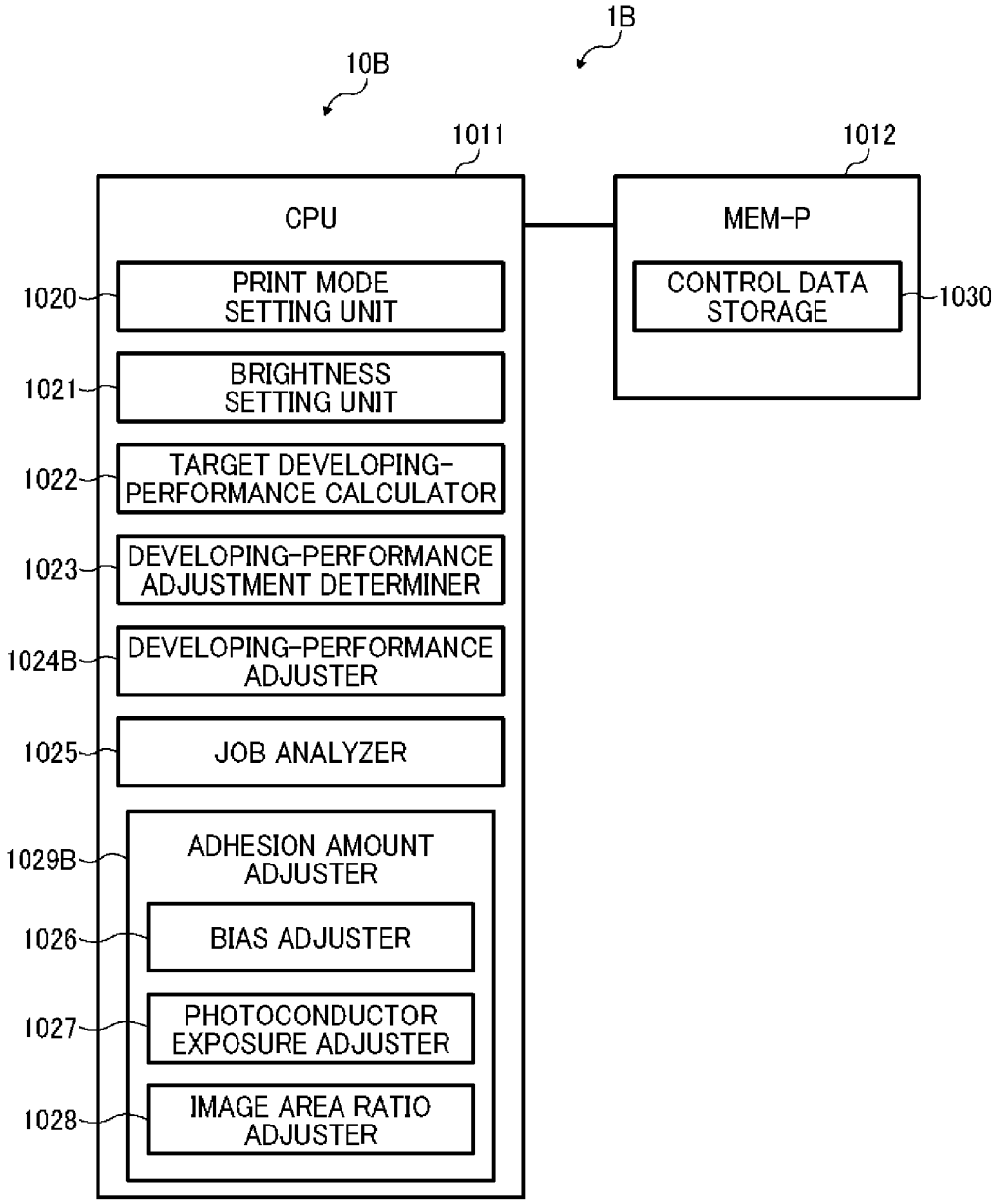
FIG. 14 is a block diagram of a configuration of a control of an image forming apparatus according to a second embodiment.

FIG. 14 illustrates a functional configuration of a control 10B of an image forming apparatus 1B according to the second embodiment. The same components as those in the first embodiment are denoted with the same reference numerals, detailed explanation thereof is omitted, and configurations different from the configurations of the first embodiment are mainly described. In the image forming apparatus 1B according to this embodiment, the control 10B includes a brightness setting unit 1021, a target developing-performance operation unit 1022, and a developing-performance adjustment determiner 1023, similar to the first embodiment.

In this embodiment, the control 10B further includes a print-mode setting unit 1020, a developing-performance adjuster 1024B, a job analyzer 1025, and an adhesion amount adjuster 1029B.

The print-mode setting unit 1020 sets any one of a productivity first mode and an image-quality first mode and executes processing, before execution of the mixed print job. Specifically, when the mixed print job is received, a print-mode selection screen is displayed on a panel display 171 of a display-and-control unit 17 to allow a user to select any one of the productivity first mode and the image-quality first mode by a control unit 172, and the selected mode is set as a print mode. As such, in the image forming apparatus 1B, when the mixed print job is processed, the high-quality first mode or the productivity first mode can be selected arbitrarily as the print mode.

Figures 15, 16:
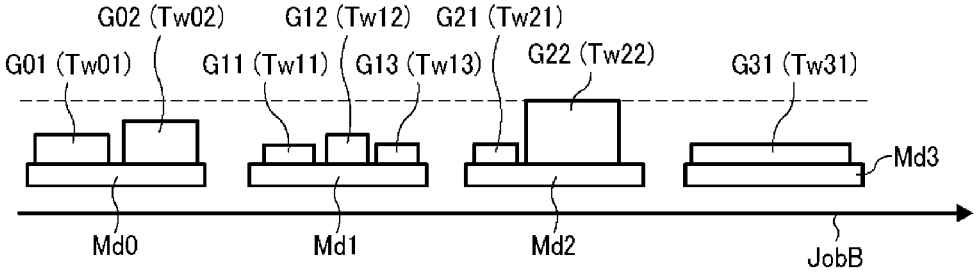
FIG. 15 is a table illustrating specifications of print modes of the image forming apparatus according to the second embodiment.
FIG. 16 is an illustration of a mixed print job processing example when a productivity first mode of the image forming apparatus according to the second embodiment is selected.

FIG. 15 is a table illustrating specifications of the print mode of the image forming apparatus 1B according to this embodiment. In the table of FIG. 15, specifications for individual items of "image quality", "productivity", "developing performance", and "developing-performance adjustment operation" are described for the image-quality first mode and the productivity first mode in particular. In an example of FIG. 15, in the image forming apparatus 1B, for the "image quality", the image-quality first mode is "excellent" and the productivity first mode is "good". For the "productivity", the productivity first mode is "excellent" and the image-quality first mode is "fair". For the "developing performance", the image-quality first mode is adjustable and the productivity first mode is fixed.

In addition, the "developing-performance adjustment operation" is executed for each job in which a white color toner adhesion amount is different in the image-quality first mode, is executed before starting processing of the mixed print job in the productivity first mode, and is not executed in a job. Specifically, in the image-quality first mode, the developing-performance adjustment operation is executed for each white color toner adhesion amount of the mixed job. Meanwhile, in the productivity first mode, the developing performance is fixed in one mixed print job and the developing-performance adjustment operation is not executed for each mixed job, so that productivity is suppressed from being deteriorated, maximum productivity is maintained, and the print is executed.

In this embodiment, the print modes of the image-quality first mode and the productivity first mode of the different specifications of FIG. 15 are selectively used, so that image-quality first print processing or productivity first print processing can be executed on the mixed print job. Image forming processing of the image-quality first mode and the productivity first mode of the mixed print job will be described in detail later.

Returning to FIG. 14, the developing-performance adjuster 1024B includes a developing-performance adjustment function when the mixed print job is processed in the case in which the productivity first mode is selected as the print mode, to be described below, in addition to the function of the developing-performance adjuster 1024 according to the first embodiment.

The job analyzer 1025 analyzes the mixed print job received by the image forming apparatus 1B from an external information processing apparatus by an operation in the display-and-control unit 17 or a network I/F 102. Specifically, the job analyzer 1025 has a function of recognizing an adhesion amount (setting value of an image density) of a white color toner and a type of print media in the received mixed print job for each page (job). In addition, the job analyzer 1025 has a function of confirming a setting value of a white color toner brightness set by the brightness setting unit 1021 by an input setting operation of the user.

The adhesion amount adjuster 1029B adjusts a white color toner developing amount on a sheet and adjusts a brightness of a white color toner image. Particularly, the adhesion amount adjuster 1029B according to this embodiment includes a bias adjuster 1026, a photoconductor exposure adjuster 1027, and an image area ratio adjuster 1028 in which processing methods to adjust a white color toner developing amount are different from each other as follows. Similar to the adhesion amount adjuster 1029 according to the first embodiment, the bias adjuster 1026 changes a developing bias between a photoconductor drum 122W and a developing sleeve in a developing device 125W in a white color image forming unit 120W and adjusts a white color toner developing amount on a sheet. The photoconductor exposure adjuster 1027 adjusts an exposure for the photoconductor drum 122W by an exposing unit 124W of the white color image forming unit 120W, that is, an exposure of a photoconductor (hereinafter, referred to as an exposure of photoconductor). The image area ratio adjuster 1028 adjusts an image area ratio of a white color toner image such that a set white color toner adhesion amount can be maintained, for white color toner image data in a job.

In the above configuration, the developing-performance adjuster 1024B executes developing-performance adjustment of the white color image forming unit 120W according to a white color toner adhesion amount, for a job in which the white color toner adhesion amount is maximum, when a mixed print job is received and the productivity first mode is selected. At this time, for processing of job pages in which the white color toner adhesion amounts are less than a maximum amount, the adhesion amount adjuster 1029B instructs the bias adjuster 1026 to change an application bias supplied to a developing roller of the developing device 125W of the white color image forming unit 120W and executes control to adjust the white color toner adhesion amount. The bias adjuster 1026 executes an operation for changing the application bias according to the instruction from the developing-performance adjuster 1024B.

When the white color toner adhesion amount adjustment control is executed on a job in which the white color toner adhesion amount is less than the maximum amount in the mixed print job, the adhesion amount adjuster 1029B can instruct the photoconductor exposure adjuster 1027 to execute the control to adjust the exposure of photoconductor for the photoconductor drum 122W. When the white color toner adhesion amount adjustment control is executed on a job in which the white color toner adhesion amount is less than the maximum amount in the mixed print job, the adhesion amount adjuster 1029B can instruct the image area ratio adjuster 1028 to execute control to adjust an image area ratio of the white color toner image for white color toner image data in the job.

FIG. 16 is an illustration of a mixed print job processing example when the productivity first mode of the image forming apparatus 1B according to this embodiment is selected.

In a mixed print job JobB illustrated in FIG. 16, a white color toner adhesion amount is different for each of print media (Md0, Md1, Md2, and Md3) used for print and the white color toner adhesion amount is different for each of image regions (G01, G02, G11, G12, G13, G21, G22, and G31) in the same print media. In the example of FIG. 16, white color toner adhesion amounts of the image regions (G01, G02, G11, G12, G13, G21, G22, and G31) are set to (Tw01, Tw02, Tw11, Tw12, Tw13, Tw21, Tw22, and Tw31), respectively.

When the mixed print job JobB is received and the productivity first mode is selected by the user, in the image forming apparatus 1B, the developing-performance adjustment operation is executed on a job in which the white color toner adhesion amount is maximum (in this example, a job in which Tw22 and Md2 are set) and is not executed on print materials in which the white color toner adhesion amounts are less than the maximum amount.

Specifically, in the image forming apparatus 1B, if the mixed print job JobB is input, a CPU 1011 (print controller described above) determines whether the print mode set by the user is the productivity first mode or the image-quality first mode. Here, when the productivity first mode is set, the job analyzer 1025 analyzes the JobB and analyzes that the print media set to the mixed jobs are Md0, Md1, Md2, and Md3, respectively. In addition, the job analyzer 1025 analyzes that the white color toner adhesion amounts Tw01 and Tw02 are set to the print medium Md0, the white color toner adhesion amounts Tw11, Tw12, and Tw13 are set to the print medium Md1, the white color toner adhesion amounts Tw21 and Tw22 are set to the print medium Md2, and the white color toner adhesion amount Tw31 is set to the print medium Md3. In addition, the job analyzer 1025 analyzes that the white color toner adhesion amount TW22 set to the print medium Md2 is maximum, from an analysis result. That is, the job analyzer 1025 recognizes that the white color toner adhesion amounts other than the white color toner adhesion amount TW22 are less than the maximum amount. The developing-performance adjuster 1024B executes the developing-performance adjustment control of the white color image forming unit 120W according to the white color toner adhesion amount (Tw22), for a job in which the white color toner adhesion amount (Tw22) is set (a job in which the print medium Md2 is set). Then, the developing performance of the white color image forming unit 120W is fixed to developing performance after adjustment and productivity first print control is executed.

In the productivity first print control, the CPU 1011 takes image data of a job of a first page of the mixed print job JobB, executes each process of exposure and developing in the white color image forming unit 120W on the basis of each white color toner image data of the job, forms a white color toner image on the photoconductor drum 122W, and outputs a print material in which the white color toner image is formed on the print medium set via each process of transfer and fixing. Then, the same image forming process is executed from a job of a second page to a job of a final page. In this case, in the image forming process for a job of a third page, the adhesion amount adjuster 1029B executes control such that an application bias based on a developing potential corresponding to the developing performance after adjustment from the bias adjuster 1026 is applied, when the white color toner image (G22) to which the maximum white color toner adhesion amount (Tw22) is set is formed.

For jobs in which the white color toner adhesion amounts are less than Tw22 (less than the maximum amount) (jobs in which the print media Md0, Md1, and Md3 are set), the adhesion amount adjuster 1029B executes a control operation for adjusting the white color toner adhesion amount by changing the application bias of the white color image forming unit 120W by the bias adjuster 1026. Here, the adhesion amount adjuster 1029B acquires the developing potential of the white color image forming unit 120W when the developing-performance adjustment of the white color image forming unit 120W is executed by the developing-performance adjuster 1024B according to the job of the third page in which the white color toner adhesion amount is maximum and calculates an application bias (developing bias) changed by the bias adjuster 1026 and applied, from a relation (refer to FIG. 5) of a developing potential versus a white color toner adhesion amount set previously, on the basis of the acquired developing potential.

As such, in the case in which an optimal developing potential is calculated from the relation of FIG. 5 and print is performed, for the jobs in which the white color toner adhesion amounts are less than the maximum amount, when the white color toner adhesion amount is small, the developing potential decreases. However, if the developing potential decreases excessively, an afterimage is generated according to a decrease in the photoconductor potential. Therefore, in the image forming apparatus 1B, the photoconductor exposure adjuster 1027 to adjust an exposure of photoconductor (laser diode (LD) power) is provided as one control function of suppressing the photoconductor potential from excessively decreasing in the adhesion amount adjuster 1029B.

Figure 17:
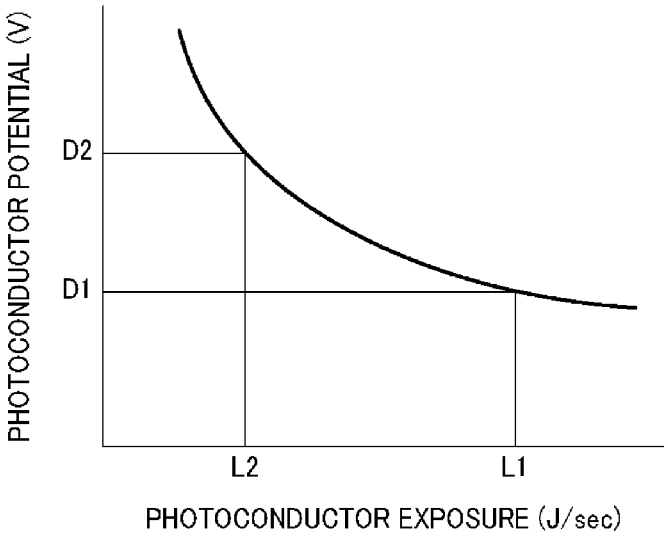
FIG. 17 is a characteristic diagram illustrating a relation of a photoconductor potential and an exposure of photoconductor for photoconductor exposure adjustment of the image forming apparatus according to the second embodiment.

FIG. 17 is a characteristic diagram illustrating a relation of a photoconductor potential and an exposure of photoconductor (LD power) for photoconductor exposure adjustment of the image forming apparatus 1B according to this embodiment. As illustrated in FIG. 17, if the exposure of photoconductor decreases, the photoconductor potential increases.

In the image forming apparatus 1B, when a value of the developing bias corresponding to the developing potential calculated from the relation of FIG. 5 is smaller than a threshold value, the adhesion amount adjuster 1029B instructs the photoconductor exposure adjuster 1027 to adjust the photoconductor exposure. The photoconductor exposure adjuster 1027 adjusts an amount of irradiation light (exposure of photoconductor) which the exposing unit 124W irradiates the surface of the photoconductor drum 122W with, such that an amount of light becomes small as compared with when the value of the developing bias is larger than the threshold value, in cooperation with adjustment control of the developing bias between the photoconductor drum 122W and the sleeve, on the basis of the instruction. As such, control to decrease the exposure of photoconductor is executed, the photoconductor potential increases, and print is performed at the high photoconductor potential, so that the afterimage can be avoided from being generated due to the excessive decrease in the photoconductor potential.

In the image forming apparatus 1B according to this embodiment, the image area ratio adjuster 1028 is included as a different example of a control function to suppress the excessive decrease in the photoconductor potential. The image area ratio adjuster 1028 executes image processing on white color toner image data in each job of the mixed print job JobB and executes the following adjustment processing of an image area ratio.

Figure 18A:
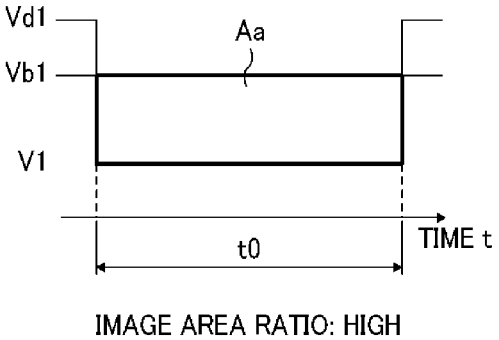
FIGS. 18A and 18B are illustrations of a relation of an image area ratio and a photoconductor potential for image area ratio adjustment of the image forming apparatus according to the second embodiment.
Figure 18B:
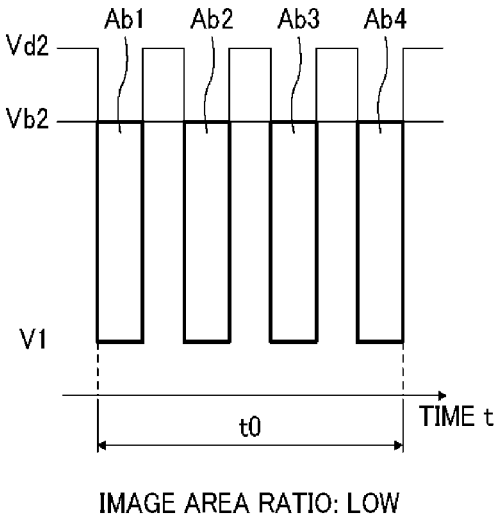

FIGS. 18A and 18B are illustrations of a relation of an image area ratio and a photoconductor potential for image area ratio adjustment of the image forming apparatus 1B according to this embodiment. In FIGS. 18A and 18B, Vd1 and Vd2 show photoconductor potentials, Vb1 and Vb2 show developing biases, V1 shows a potential of an exposed portion of a photoconductor, and (Vb1-V1) and (Vb2-V1) show developing potentials. In FIG. 18A, an area of a region Aa obtained by multiplying a length (height) corresponding to the developing potential (Vb1-V1) with a length (width) corresponding to an application time (t0) is a total sum of the developing potential and the total sum of the developing potential corresponds to a white color toner adhesion amount of a white color toner image of a processing target. In addition, in FIG. 18B, a total sum of areas of regions Ab1, Ab2, Ab3, and Ab4 obtained by multiplying a length (height) corresponding to the developing potential (Vb2-V1) with a length (width) corresponding to an application time (in this example, t0/7) is the same as the area of the region Aa in FIG. 18B. That is, according to application patterns of the developing potentials illustrated in FIGS. 18A and 18B, a white color toner adhesion amount set previously to the white color toner image can be maintained.

In FIG. 18A, the developing bias Vb1 is applied continuously for a time t0 and in FIG. 18B, the developing bias Vb2 is applied intermittently at a time interval obtained by dividing the time t0 in a plurality of parts (in this example, the time is divided by 7). In FIGS. 18A and 18B, if a ratio of a valid white color toner image (that is, an image area when the developing bias is applied) in an entire white color toner image region (it corresponds to a size of the region Aa in FIG. 18A and corresponds to an area of a region obtained by multiplying a height of the region Ab1 (including the regions Ab2, Ab3, and Ab4) with the time t0 in FIG. 18B) is taken as an image area ratio, the image area ratio is "1" in FIG. 18A and the image area ratio is "4/7" in FIG. 18B.

According to the characteristic illustrated in FIGS. 18A and 18B, when the same white color toner adhesion amount is obtained for the targeted white color toner image, a high developing potential (Vb2-V1) is necessary in a low image area ratio (refer to FIG. 18B). In the control 10B of the image forming apparatus 1B, the image area ratio adjuster 1028 executes image area ratio adjustment processing illustrated in FIGS. 18A and 18B for white color toner image data in each job, in the developing process of the jobs in which the white color toner adhesion amounts are less than the maximum amount, in the mixed print job JobB. Specifically, when the value of the developing bias corresponding to the developing potential calculated from the relation of FIG. 5 is less than the predetermined threshold value, the adhesion amount adjuster 1029B instructs the image area ratio adjuster 1028 to adjust the image area ratio. The image area ratio adjuster 1028 executes image processing (area ratio adjustment processing) for changing the white color toner image to a white color toner image of an area ratio lower than an area ratio where the previously set white color toner adhesion amount can be maintained, on the basis of the instruction, and sets the developing bias corresponding to the white color toner image after the change.

By the image area ratio adjustment processing, the image area ratio of the white color image data is decreased from FIG. 18A to FIG. 18B, so that the photoconductor potential can be maintained high. Therefore, according to the configuration including the image area ratio adjuster 1028, the image area ratio is adjusted for the afterimage generated when the photoconductor potential excessively decreases and the developing performance is excessively high, the photoconductor potential is adjusted to the photoconductor potential in which the afterimage does not occur, occurrence of the afterimage is suppressed, and superior image forming is enabled. In this embodiment, as illustrated in FIG. 14, the configuration including both the photoconductor exposure adjuster 1027 and the image area ratio adjuster 1028 is exemplified. However, a mechanism for selectively driving any one of the photoconductor exposure adjuster 1027 and the image area ratio adjuster 1028 may be provided. In addition, a configuration including any one of the photoconductor exposure adjuster 1027 and the image area ratio adjuster 1028 may be adopted.

When the mixed print job JobB illustrated in FIG. 16 is received and the image-quality first mode is set, the CPU 1011 executes the image-quality first print control. In the image-quality first print control, the developing-performance adjuster 1024B adjusts the developing performance of the white color image forming unit 120W for each white color toner adhesion amount of the print medium, on the basis of the type of the print medium of each job of the mixed print job JobB by the job analyzer 1025. As such, in the image-quality first mode, the developing performance is adjusted to optimal developing performance for each white color toner adhesion amount of the print medium, so that a high-definition white color image can be stably printed.

As described above, in the image forming apparatus 1B according to this embodiment, when the productivity first mode is set at the time of receiving the mixed print job in which the plurality of jobs where the white color toner adhesion amounts and the types of the print media recognized (analyzed) by the job analyzer 1025 are set differently are mixed while maintaining the function of adjusting the developing performance of the white color image forming unit 120W to developing performance different from the developing performance fixedly applied to each of the standard-color image forming units 120Y, 120M, 120C, and 120K according to the white color toner brightness setting value in the brightness setting unit 1021, the developing-performance adjuster 1024B executes developing-performance adjustment of the white color image forming unit 120W according to the special color toner adhesion amount, for the job in which the white color toner adhesion amount is maximum in the mixed print job, and the adhesion amount adjuster 1029B adjusts the white color toner adhesion amount by changing the application bias (developing bias) of the white color image forming unit 120W, for the jobs in which the white color toner adhesion amounts are less than the maximum amount. For this reason, when the mixed print job is received, the white color toner adhesion amount can be adjusted appropriately for each job.

In addition, in the image forming apparatus 1B according to this embodiment, the adhesion amount adjuster 1029B acquires the developing potential of the white color developing device when the developing-performance adjuster 1024B executes the developing-performance adjustment of the white color image forming unit 120W for the job in which the white color toner adhesion amount is maximum and calculates the changed application bias (developing bias) from the acquired relation of the developing potential and the special color toner adhesion amount. For this reason, the process control does not need to be executed on a print material in which the white color toner adhesion amount is different and the print can be executed without deteriorating the productivity.

The image forming apparatus 1B according to this embodiment further has the photoconductor exposure adjuster 1027 to adjust the exposure of the photoconductor of the white color image forming unit 120W and when the white color toner images in the jobs in which the white color toner adhesion amounts are less than the maximum amount are developed, the adhesion amount adjuster 1029B executes adjustment of the exposure of the photoconductor by the photoconductor exposure adjuster 1027. For this reason, the exposure of the photoconductor is adjusted for the afterimage occurred when the developing performance is excessively high, the photoconductor potential is adjusted to the photoconductor potential in which the afterimage does not occur, occurrence of the afterimage is suppressed, and superior image forming can be realized.

The image forming apparatus 1B according to this embodiment further has the image area ratio adjuster 1028 that adjusts the image area ratio of the white color toner image, such that the set white color toner adhesion amount can be maintained, for the white color toner image data in the job. When the white color toner images in the jobs in which the white color toner adhesion amounts are less than the maximum amount are developed, the adhesion amount adjuster 1029B executes adjustment of the area ratio of the white color toner image by the image area ratio adjuster 1028. For this reason, the area ratio of the white color toner image is adjusted, the photoconductor potential is adjusted to the photoconductor potential in which the afterimage does not occur, occurrence of the afterimage is suppressed, and superior image forming can be realized.

The image forming apparatus 1B according to this embodiment also has the components common to the components of the image forming apparatus 1A according to the first embodiment. However, the same effects as the first embodiment can be obtained by the components.

Specifically, in the image forming apparatus 1B, the developing-performance adjuster 1024B has the same developing-performance adjustment function of the white color image forming unit 120W as the developing-performance adjuster 1024 according to the first embodiment. For this reason, the white color toner adhesion amount (brightness) can be adjusted in a wide range without depending on a density adjustment range of the standard color toner, according to setting of the white color toner brightness.

In addition, in the image forming apparatus 1B, the developing-performance adjuster 1024B has a function of using one of the surface velocity ratio change function of the developing sleeve and the photoconductor drum of the white color image forming unit 120W and the toner density change function of the white color toner in the developer or using both the surface velocity ratio change function and the toner density change function, similar to the developing-performance adjuster 1024 according to the first embodiment. For this reason, it is possible to correspond to wide developing-performance adjustment by using a plurality of developing-performance adjusters together.

In addition, in the image forming apparatus 1B, the developing-performance adjuster 1024B determines the threshold value of the white color toner adhesion amount in the print job recognized by the job analyzer 1025, selects any one of the previously stored adhesion amount modes, and performs adjustment of the developing performance of the white color image forming unit 120W to be matched with the previously set developing-performance setting value corresponding to the selected adhesion amount mode, similar to the developing-performance adjuster 1024 according to the first embodiment. For this reason, feed forward processing is enabled by storing the optimal values previously and an operation (repetition of the operation) for adjusting the developing performance and confirming the special color toner adhesion amount is unnecessary, which results in contributing to downtime reduction.

In addition, similar to the first embodiment, the image forming apparatus 1B determines the threshold value of the white color toner adhesion amount calculated on the basis of the white color toner bright setting value by the brightness setting unit 1021, selects any one of the adhesion amount modes, and adjusts the developing performance of the white color image forming unit 120W to be matched with the developing-performance setting value corresponding to the selected adhesion amount mode. For this reason, it is possible to correspond to automatic adjustment of the developing performance when the white color toner adhesion amount is adjusted by the user.

In addition, similar to the first embodiment, in the image forming apparatus 1B, the brightness data of the white color toner set for each type of the sheet is stored and the brightness setting unit 1021 sets the white color toner brightness on the basis of the brightness data set to correspond to the type of the sheet selected by the user. For this reason, the optimal special color toner adhesion amount for each sheet is provided to the user, the user can designate the target brightness by only a selection operation of the sheet, and convenience of the system is improved.

In addition, similar to the first embodiment, in the image forming apparatus 1B, the variable range of the white color toner adhesion amount by adjustment of the developing performance is wider than the variable range of the standard color toner adhesion amount. For this reason, a special color toner system in which an adjustment width of the white color toner brightness is large and versatility is high can be provided.

In addition, similar to the first embodiment, in the image forming apparatus 1B, the white color toner adhesion amount setting value by adjustment of the developing performance of the white color image forming unit 120W and the standard color toner adhesion amount setting value are independent from each other and do not conflict with each other. For this reason, a print material of a high added value in which decoration by a white color toner image of a high brightness is executed while a full-color color reproduction range by a standard color toner is secured can be provided.

In addition, similar to the first embodiment, in the image forming apparatus 1B, adjustment of the developing performance of the white color image forming unit 120W is setting that is available for a white brightness L*=80 or more on a contrast-ratio test sheet having a white side having visible reflectance of 802±2 and a black side having visible reflectance of 5 or less in an image area ratio of 100%. For this reason, a print material of a high added value in which the decoration by the special color toner image of the high brightness is executed can be provided.

Other Embodiment

The present disclosure is not limited to the embodiments described above and various changes and modifications can be made without departing from the scope of the present disclosure.

For example, in the first and second embodiments, the image forming apparatus 1 includes the white color image forming unit 120W to form the white color toner image. However, the image forming apparatus 1 is not limited thereto and the image forming apparatus 1 can be applied to a configuration in which a special color image forming unit using a special color toner (toner to form an added image for decoration appeals in addition to a standard color image) other than the standard color toners such as a clear toner is included and developing performance of the special color image forming unit is adjusted according to setting of a special color toner brightness.

As described above, the image forming apparatus according to the present disclosure has an effect of widely adjusting brightness of the special color toner used in addition to the standard color toners and can be applied to all image forming apparatuses using a special color toner such as a white color toner in addition to the standard color toners.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a photoconductor to form an electrostatic latent image;

a special color developing device to develop the electrostatic latent image with a special color toner other than standard color toners on the photoconductor to form a special color toner image;

an adhesion amount adjuster to adjust a special color toner adhesion amount by changing an application bias between the photoconductor and a developing sleeve of the special color developing device;

a setting unit to set brightness of the special color toner;

a developing-performance adjuster to adjust a developing performance of the special color developing device according to a setting value of the brightness of the special color toner set by the setting unit, wherein the developing-performance adjuster adjusts the developing performance of the special color developing device to a developing performance different from a developing performance set to each of standard color developing devices in adjustment of densities of the standard color toners;

a mode setting unit to set one of a productivity first mode and an image-quality first mode on receipt of a mixed job including a plurality of jobs with different settings in the special color toner adhesion amount and a type of recording media; and a job analyzer to recognize the special color toner adhesion amount and the type of the recording media for each of the plurality of jobs in the mixed job, wherein, when the productivity first mode is set, the developing-performance adjuster executes adjustment of the developing performance of the special color developing device according to the special color toner adhesion amount, for a job having a maximum special color toner adhesion amount in the mixed job, and the adhesion amount adjuster adjusts the special color toner adhesion amount by changing the application bias of the special color developing device, for a job having a special color toner adhesion amount less than the maximum special color toner adhesion amount.

2. The image forming apparatus according to claim 1, wherein the adhesion amount adjuster acquires a developing potential of the special color developing device when the developing-performance adjuster executes the adjustment of the developing performance of the special color developing device for the job having the maximum special color toner adhesion amount and calculates the changed application bias from a relation of the acquired developing potential and a lesser special color toner adhesion amount.

3. The image forming apparatus according to claim 1, further comprising:

a photoconductor exposure adjuster to adjust an exposure of the photoconductor, wherein the adhesion amount adjuster executes adjustment of the exposure of the photoconductor with the photoconductor exposure adjuster when the special color toner image is developed in the job having the special color toner adhesion amount less than the special color toner adhesion maximum amount.

4. The image forming apparatus according to claim 1, further comprising:

an image area ratio adjuster to adjust an image area ratio of the special color toner image to maintain a special color toner adhesion amount set for special color toner image data in a job, wherein the adhesion amount adjuster executes adjustment of the image area ratio with the image area ratio adjuster when the special color toner image is developed in the job having the special color toner adhesion amount less than the maximum special color toner adhesion amount.

5. The image forming apparatus according to claim 1, wherein the developing-performance adjuster executes adjustment of the developing performance by using one of a function of changing a surface velocity ratio of the developing sleeve and the photoconductor according to the setting value of the brightness of the special color toner and a function of changing a toner density of the special color toner in a developer or using both the functions.

6. The image forming apparatus according to claim 1, wherein the developing-performance adjuster associates a plurality of adhesion amount modes having different threshold values of the special color toner adhesion amount with optimal developing-performance setting values of the plurality of adhesion amount modes, retains association data of the plurality of adhesion amount modes and the optimal developing-performance setting values, determines a threshold value of the special color toner adhesion amount in a job recognized by the job analyzer, selects one of the plurality of adhesion amount modes, and executes adjustment of the developing performance so that the developing performance matches the developing-performance setting value corresponding to the selected adhesion amount mode.

7. The image forming apparatus according to claim 6, wherein the developing-performance adjuster determines a threshold value of an adhesion amount of the special color toner calculated based on the setting value of the brightness of the special color toner set by the setting unit, selects any one of the adhesion amount modes, and executes adjustment of the developing performance to be matched with the developing-performance setting value corresponding to the selected adhesion amount mode.

8. The image forming apparatus according to claim 1, further comprising:

a storage device to store brightness data of a special color toner set for each type of recording media, wherein the setting unit sets the brightness of the special color toner according to the brightness data.

9. The image forming apparatus according to claim 1, wherein a variable range of the special color toner adhesion amount by adjustment of the developing performance is greater than a variable range of standard color toner adhesion amounts.

10. The image forming apparatus according to claim 1, wherein a setting value of the special color toner adhesion amount by adjustment of the developing performance and a setting value of standard color toner adhesion amounts are independent from each other and do not conflict with each other.

11. The image forming apparatus according to claim 1, wherein adjustment of the developing performance is available for a white brightness $L^*=80$ or more on a contrast-ratio test sheet having a white side having visible reflectance of 802±2 and a black side having visible reflectance of 5 or less in an image area ratio of 100%.

12. An image forming method, comprising:

forming an electrostatic latent image on a photoconductor;

developing the electrostatic latent image on the photoconductor with a special color toner other than standard color toners to form a special color toner image;

adjusting a special color toner adhesion amount by changing an application bias between the photoconductor and a developing sleeve of the special color developing device;

setting brightness of the special color toner;

adjusting a developing performance of the special color developing device according to a setting value of the brightness of the special color toner;

adjusting the developing performance of the special color developing device to a developing performance different from a developing performance set to each of standard color developing devices in adjustment of densities of the standard color toners setting one of a productivity first mode and an image-quality first mode on receipt of a mixed job including a plurality of jobs with different settings in the special color toner adhesion amount and a type of recording media;

recognizing the special color toner adhesion amount and the type of the recording media for each of the plurality of jobs in the mixed job, in response to setting the productivity first mode, executing adjustment of the developing performance of the special color developing device according to the special color toner adhesion amount, for a job having a maximum special color toner adhesion amount in the mixed job, and adjusting the special color toner adhesion amount by changing the application bias of the special color developing device, for a job having a special color toner adhesion amount less than the maximum special color toner adhesion amount.

* * * * *